United States Patent [19]

Walker et al.

[11] Patent Number: 5,058,888

[45] Date of Patent: Oct. 22, 1991

[54] AUTOMATIC FORCE GENERATING AND CONTROL SYSTEM

[75] Inventors: Christopher W. Walker, Middleburg; Michael M. Szafranski, Fairfax, both of Va.; Sung H. Kim, Palo alto; Howell F. Hsiao, Mountain Beach, both of Calif.; Steven R. Frank, Golden, Colo.

[73] Assignee: Walker Fitness Systems, Inc., Reston, Va.

[21] Appl. No.: 436,191

[22] Filed: Nov. 13, 1989

[51] Int. Cl.[5] ..... A63B 21/008

[52] U.S. Cl. ..... 272/130; 272/129; 272/134; 272/143; 272/144

[58] Field of Search ..... 272/73, 117, 118, 123, 272/125, 129, 130, 132, 134, 143, 144; 128/25 R

[56] References Cited

U.S. PATENT DOCUMENTS

| | | | |
|---|---|---|---|
| D. 296,709 | 7/1988 | Gvoich et al. . | |
| D. 300,233 | 3/1989 | Griffin . | |
| D. 300,647 | 4/1989 | Griffin . | |
| 3,465,592 | 9/1969 | Perrine | 272/130 |
| 3,495,824 | 2/1970 | Cuinier | 272/130 |
| 3,640,527 | 2/1972 | Proctor . | |
| 3,856,297 | 12/1974 | Schnell | 272/117 X |
| 3,892,404 | 7/1975 | Martucci | 272/134 |
| 4,063,726 | 12/1977 | Wilson | 272/130 X |
| 4,183,520 | 1/1980 | Chase | 272/130 |
| 4,227,689 | 10/1980 | Keiser | 272/130 |
| 4,247,098 | 1/1981 | Brentham | 272/130 |
| 4,254,949 | 3/1981 | Brentham | 272/130 |
| 4,258,913 | 3/1981 | Brentham | 272/130 X |
| 4,275,882 | 6/1981 | Grosser et al. | 272/117 |
| 4,326,707 | 4/1982 | Strecker | 272/130 |
| 4,354,676 | 10/1982 | Ariel | 272/130 |
| 4,357,010 | 11/1198 | Telle | 272/130 X |
| 4,363,481 | 12/1982 | Erickson | 272/134 X |
| 4,407,495 | 10/1983 | Wilson | 272/117 |
| 4,422,636 | 12/1983 | De Angeli | 272/143 X |
| 4,441,708 | 4/1984 | Brentham | 272/130 |
| 4,448,412 | 5/1984 | Brentham | 272/130 |
| 4,452,447 | 6/1984 | Lepley et al. | 272/130 X |
| 4,478,412 | 10/1984 | Muir | 272/130 |
| 4,482,152 | 11/1984 | Wolff | 272/130 |
| 4,533,136 | 8/1985 | Smith et al. | 272/73 |
| 4,544,154 | 10/1985 | Ariel | 272/129 |
| 4,566,691 | 1/1986 | Mahnke | 272/123 |
| 4,569,518 | 1/1986 | Fulks | 272/129 |
| 4,600,189 | 7/1986 | Olschansky et al. | 272/134 X |
| 4,601,468 | 7/1986 | Bond et al. | 272/130 |
| 4,603,855 | 8/1986 | Sebelle | 272/134 X |
| 4,609,190 | 9/1986 | Brentham | 272/130 |
| 4,629,185 | 12/1986 | Amann | 272/130 |

(List continued on next page.)

OTHER PUBLICATIONS

Newsweek Magazine, p. 43, Sep. 14, 1981.

*Primary Examiner*—Robert Bahr

*Attorney, Agent, or Firm*—Dickstein, Shapiro & Morin

[57] ABSTRACT

An automatic force generating and control system including a lever pivotally attached to a monolith and a lower body exerciser pivotally attached to a bench, with both the bench and monolith attached to a platform. The rotation of the lower body exerciser is translated into linear movement by a series of sprockets and timing belts. The electrical output from load cells and potentiometers are processed by the electronic controls to determine the speed, direction and position and the amount and direction of force being exerted on the lever and lower body exerciser. Resistance to movement is provided by a lever hydraulics assembly and a lower body hydraulics assembly. The lever has arms and handles which articulate to the physique of the user and the exercise to be performed. The arms pivot in mirror relationship and the lower body exerciser may be lengthened or shortened. Electric solenoid clutches or hydraulics may engage the handles to the arms and the arms to the head of the lever. In an alternate embodiment, a mechanical linkage may transmit rotation between the arm and the lower body exerciser negating the need for one of the hydraulics assemblies.

37 Claims, 26 Drawing Sheets

U.S. PATENT DOCUMENTS

| | | | |
|---|---|---|---|
| 4,634,127 | 1/1987 | Rockwell | 272/134 |
| 4,635,933 | 1/1987 | Schnell | 272/129 |
| 4,640,268 | 2/1987 | Roberts | 272/143 X |
| 4,667,995 | 5/1987 | Giesch | 272/130 |
| 4,705,271 | 11/1987 | Mondloch et al. | 272/130 |
| 4,711,448 | 12/1987 | Minkow et al. | 272/134 X |
| 4,711,450 | 12/1987 | McArthur | 272/129 |
| 4,721,303 | 1/1988 | Fitzpatrick | 272/134 X |
| 4,722,525 | 2/1988 | Brentham | 272/130 |
| 4,726,582 | 2/1988 | Fulks | 272/129 |
| 4,733,859 | 3/1988 | Kock et al. | 272/130 X |
| 4,746,115 | 5/1988 | Lahman | 272/130 |
| 4,765,611 | 8/1988 | MacMillan | 272/130 X |
| 4,765,613 | 8/1988 | Voris | 272/129 |
| 4,778,175 | 10/1988 | Wucherpfenning et al. | 272/129 |
| 4,793,608 | 12/1988 | Mahnke et al. | 272/134 X |
| 4,799,670 | 1/1989 | Williamson | 272/134 X |
| 4,799,676 | 1/1989 | Sheppard et al. | 272/130 |
| 4,801,139 | 1/1989 | Vanhoutte et al. | 272/130 |
| 4,811,946 | 3/1989 | Pelczar | 272/123 |
| 4,822,038 | 4/1989 | Mason | 272/134 |
| 4,826,157 | 5/1989 | Fitzpatrick | 272/134 |
| 4,826,158 | 5/1989 | Fields, Jr. | 272/144 |
| 4,828,257 | 5/1989 | Dyer et al. | 272/129 |
| 4,830,362 | 5/1989 | Bull | 272/130 X |
| 4,844,055 | 7/1989 | Radcliffe | 272/125 X |
| 4,846,458 | 7/1989 | Potts | 272/130 X |
| 4,846,466 | 7/1989 | Stima, III | 272/130 |
| 4,848,739 | 7/1989 | Schaub et al. | 272/134 |
| 4,863,161 | 9/1989 | Telle | 272/130 X |
| 4,865,315 | 9/1989 | Paterson et al. | 272/130 |
| 4,869,497 | 9/1989 | Stewart et al. | 272/129 |
| 4,871,166 | 10/1989 | Sterba et al. | 272/144 |
| 4,872,668 | 10/1989 | McGillis et al. | 272/130 |
| 4,872,669 | 10/1989 | Henry | 272/134 X |
| 4,898,381 | 2/1990 | Gordon | 272/134 X |
| 4,943,051 | 7/1990 | Haskins et al. | 272/130 X |

10
120
100
160
171
40
162
126
30
245
200
230
220
300
340
330
320
210
232
310
350
318
20
24
25
24

10
126
30
220
245
210
230
330
340
300
212
240
200
334
350
318
310
20
24
25
36
24

FIG. 4
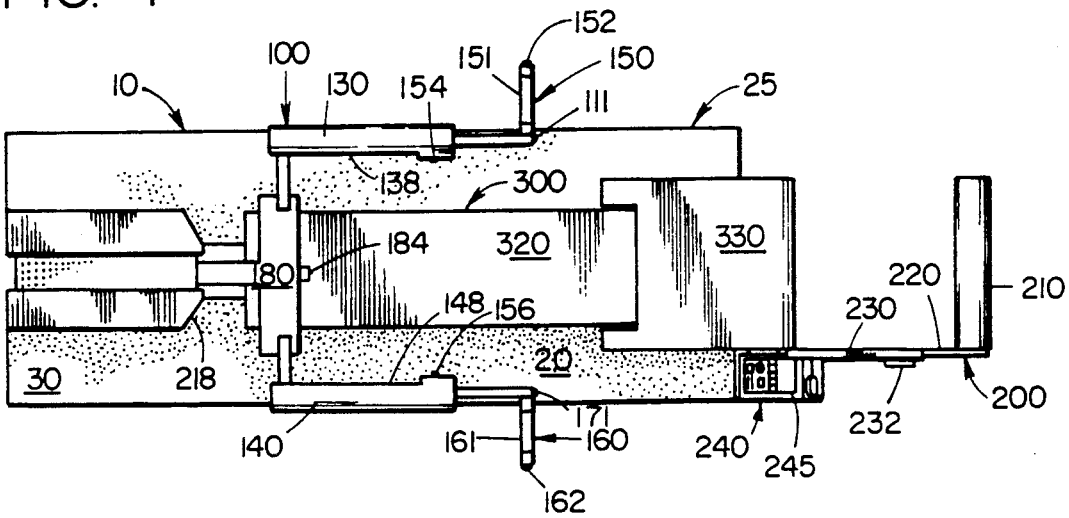
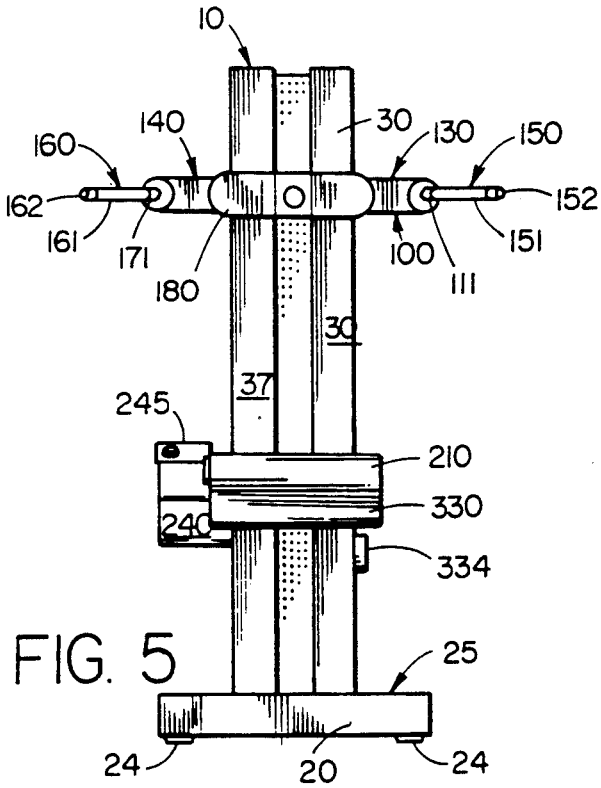
FIG. 5
FIG. 6
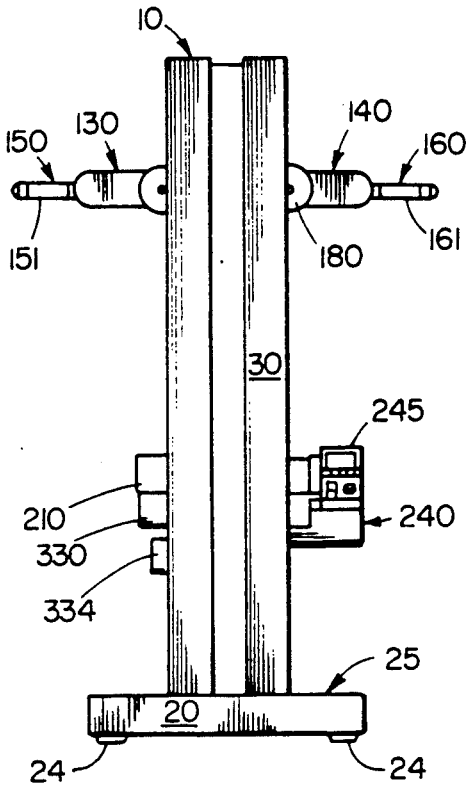

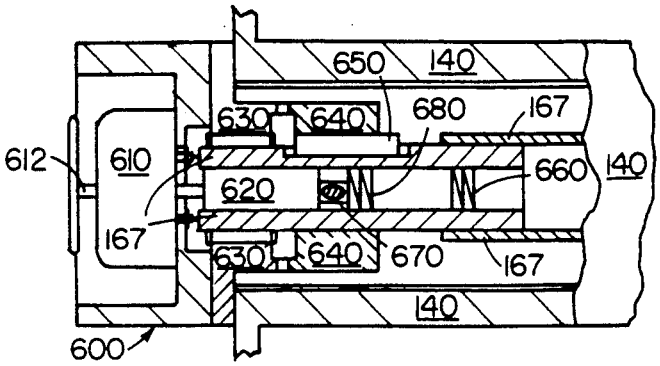
FIG. 20
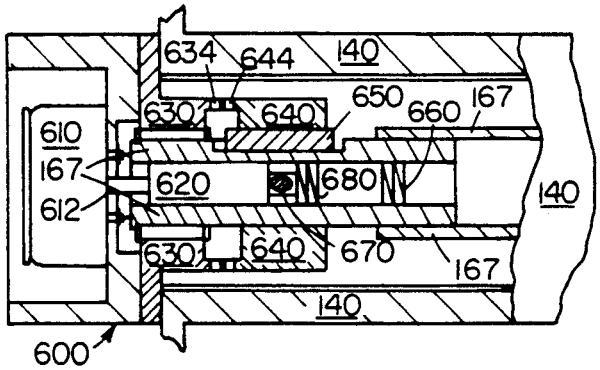
FIG. 21
FIG. 23
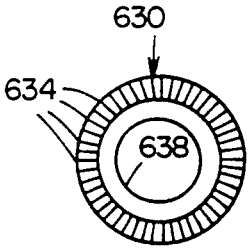
FIG. 22
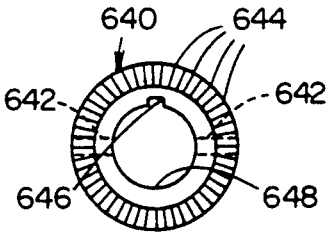
FIG. 24
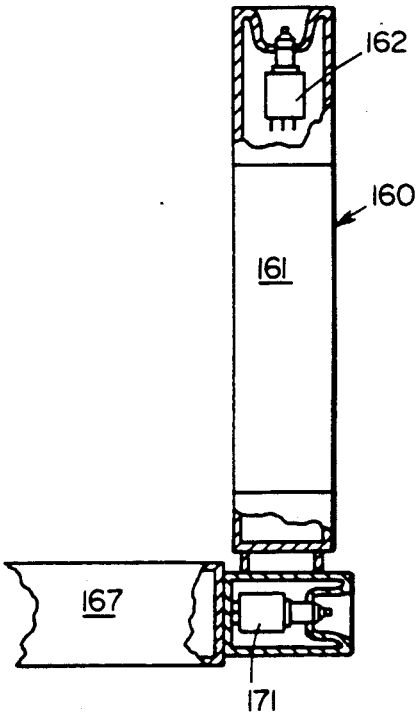

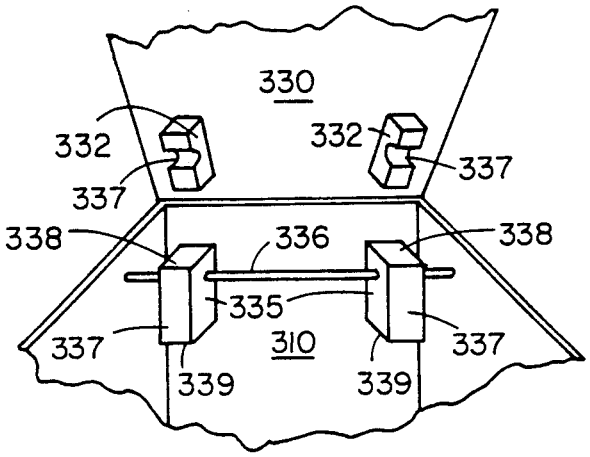
FIG. 46
FIG. 48
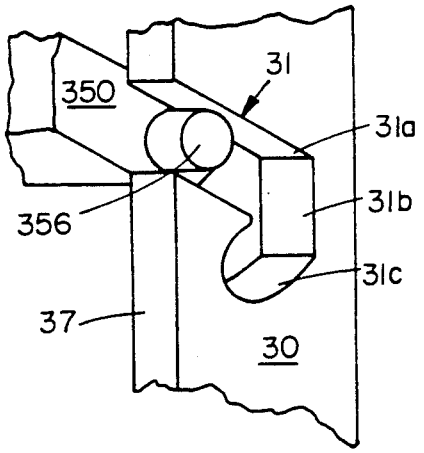
FIG. 49
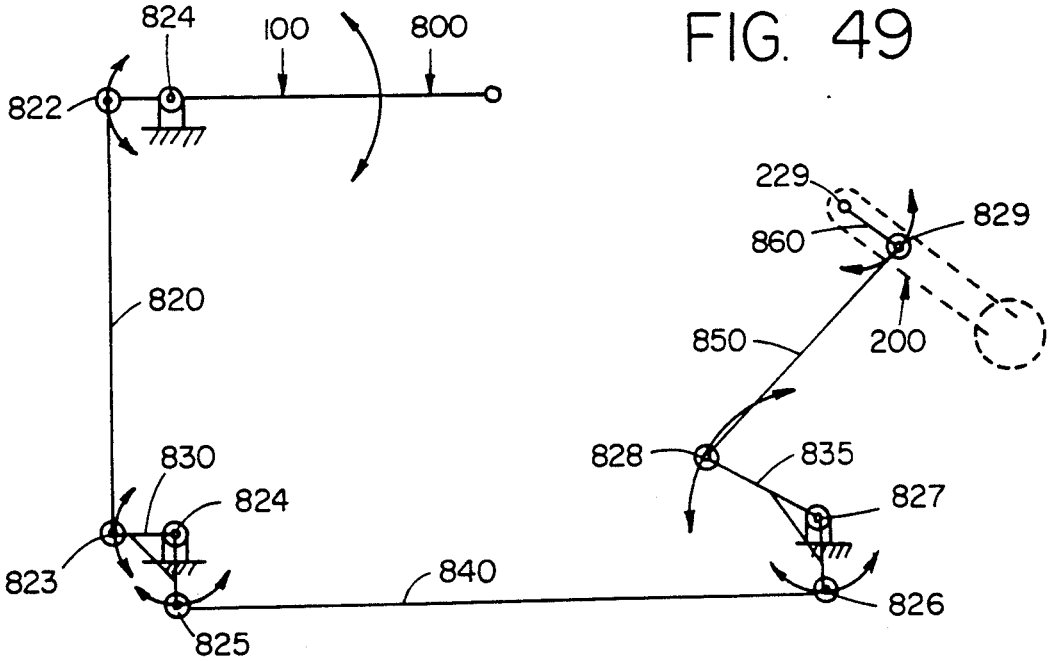

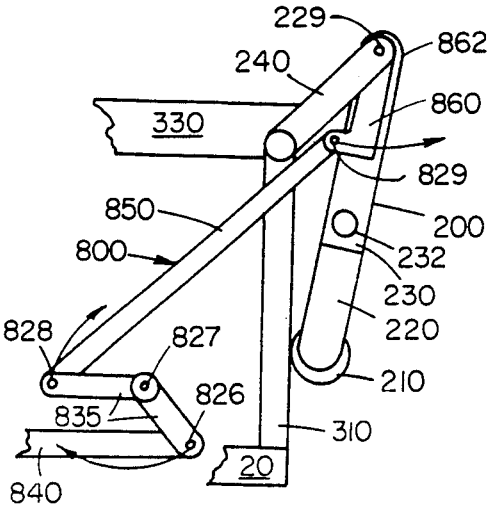
FIG. 50
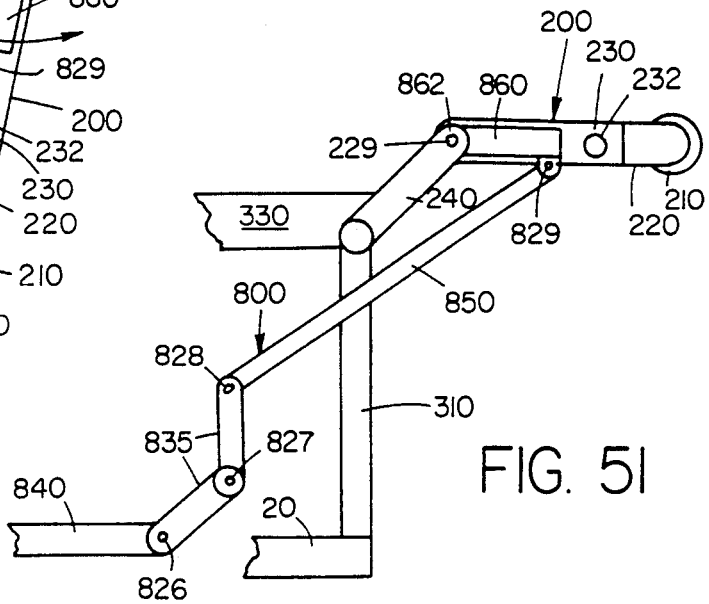
FIG. 51
FIG. 52
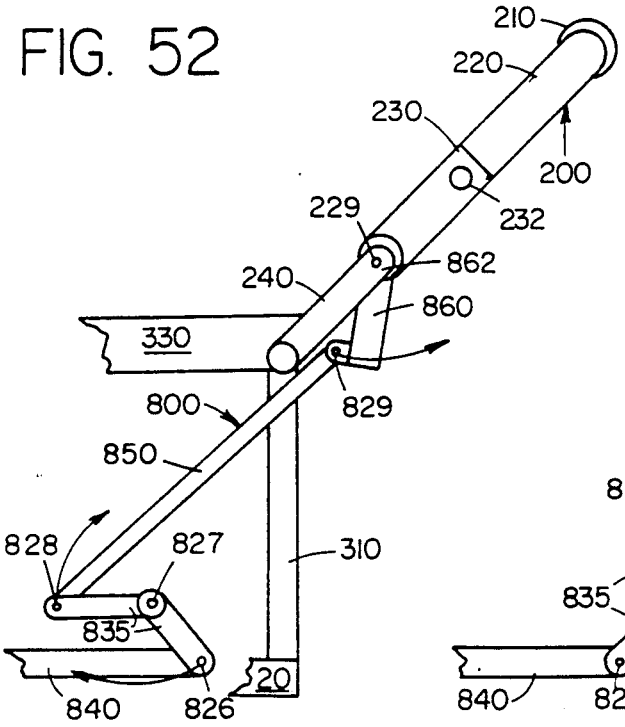
FIG. 53
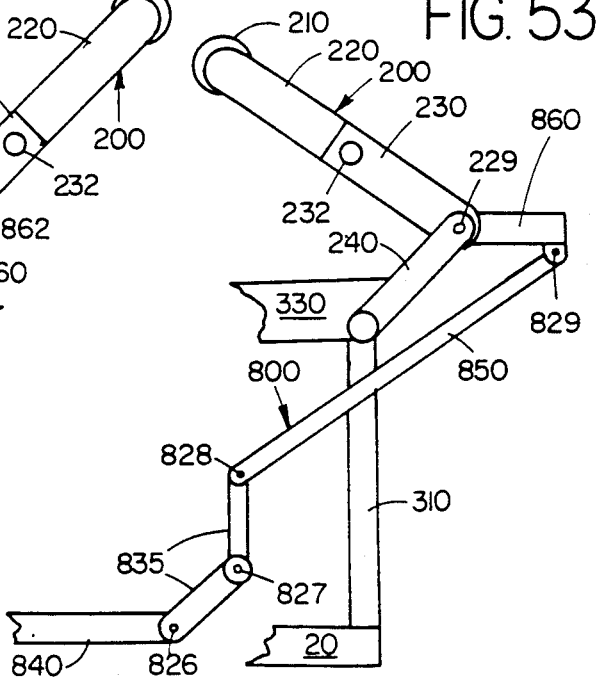

AUTOMATIC FORCE GENERATING AND CONTROL SYSTEM

BACKGROUND OF THE INVENTION

This invention relates to an automatic force generating and control system and, in particular, a mechanical system for an automatic force generating and control system.

As exercise is becoming an increasingly important part of our daily routine, the demand for quality exercise machinery has become more pronounced. A particular focus for this demand centers on weight lifting machines that enable a user to achieve a total workout in a small amount of space.

Because many users have a limited amount of space in their own homes or apartments or, for that matter, at their exercise facilities, those users must be concerned with locating as much equipment as possible into smaller spaces. The attainment of these objectives poses certain problems when examining currently available exercise devices.

First, the compact designs, such as stacked-weight systems, employ cable connected weights that move along rails or bars. When more than one user is exercising, however, the weights will often drop suddenly causing the device to jerk and move. Those movements in the weights will often disturb the concentration of others, and occasionally result in injuries.

An additional disadvantage of stacked-weight systems is their lack of flexibility. Each station in such a device is primarily restricted to one or possibly two exercises. To work out the entire body, therefore, a user must rotate around to multiple stations. A total workout thus requires between eight to ten changes of location. To pace his/her workout accordingly, the user must be assured that the stations remain free. When the universal machine is crowded with multiple users, such a workout can be difficult, if not impossible.

A further problem with stacked-weight systems is the generation of force on the return stroke. Stacked and free weight systems do not allow the return force to be set substantially higher than the force setting for the initial stroke. However, the muscoskeletal system yields more effective results from the point of strength gain when a higher force setting is set on the return stroke. Accordingly, conventional resistance machines using dead weights have an inherent design deficiency from the perspective of exercise efficiency.

A further disadvantage to the present weight lifting systems is their lack of personalized control. With the advent of computers and electronic control systems, there exists a need for a progressive resistance system that can store the force profiles of its users and tailor the exercise routines in accordance with those profiles. Thus, the person who wishes to use a machine for keeping count of his or her repetitions, for calculating a progressively challenging exercise regimen, or for visually and audibly prompting his/her exercises, can be served by a machine that takes advantage of these technologies.

An additional need of users of weight lifting systems is motivation. Over the course of a workout, the user needs a way to set exercise goals and receive motivational feedback messages. Goals take the form of allowing the user to set work-out targets that are both short term and long term in nature. Feedback can include visual indications of the workout that allow the user to track his/her range of motion, clock the length of the workout, and provide cumulative ratings of the exercise results. Feedback also can include audio motivation such as counting repetitions, audio precautions, printouts of various exercise related data, and congratulatory statements.

A further disadvantage of the current exercise equipment is their lack of ability to customize the start and finish of an exercise stroke to the physical properties of the user. Specifically, the current machines are designed for one individual of a particular size. Larger individuals may be cramped while smaller individuals may be strained and perhaps totally unable to position themselves properly with respect to the equipment. Further, the start point for each exercise cannot be varied. Thus, each user is required to start the exercise stroke at the same start point regardless of whether this start point is comfortable. This enforced uniformity may injure or unnecessarily tire the user because the user may be required to exercise during some portion of the stroke which is not appropriate for the user's particular physique. Conventional weight machines do not allow the user to configure the machine to his/her individual physique and move the equipment under minor resistance to the start position most comfortable to the user before initiating resistance to movement.

Finally, there is an important need to provide safety for the exerciser. A free weight system relies on an extra person to "spot" the weight lifter. If the user is alone, however, he often risks injury. Thus, a need exists for a system that contains safety features without demanding the presence of an extra person. Moreover, there is a need for a safety device which prevents children or unauthorized people from using the system without permission.

SUMMARY AND OBJECTS OF THE INVENTION

It is, therefore, an object of this invention to overcome the above-described deficiencies by providing an automatic force generating and control system comprising a compact, multi-purpose exercise machine which includes an articulating arm which can be modified and reconfigured to accommodate the individual user's physique. A potentiometer on the arm pivot and a load cell at the base of the arm hydraulics provide electronic information concerning the position, speed and direction of the arm as well as the magnitude and direction of force being exerted by the user on the arm. This information is used as feed back to control the system. The seat and back portion of the bench may be pivoted to different configurations depending upon the physique of the individual and the exercise to be performed. The leg hydraulics translate pivotal motion of the lower body exerciser bar into linear movement. Again, a load cell and potentiometer provide feed back to the electronic controls. The positioning of the arm with respect to the individual is performed by separate clutch mechanisms between the handle and the arm of each arm as well as clutch mechanisms between the arm and head of each arm. The arms move in mirror relationship to one another so that movement of one arm results in corresponding movement of the other arm.

Both the arm and the lower body exerciser may be positioned with little resistance until the desired start point is achieved, at which time the user may initiate resistance to movement and thereby exercise.

It is a further object of this invention to provide an exercise machine positioning system.

It is an additional object of this invention to provide an exercise handle positioning system.

It is yet another object of this invention to provide an exercise arm rotational transmission system.

It is still another object of this invention to provide an exercise motion transmission system.

It is a further object of this invention to provide an exercise monitoring system.

It is an additional object of the invention to provide and exercise machine adjustment system.

These objects are provided for in an automatic force generating and control system which includes an arm pivotally attached to a monolith and a leg exerciser pivotally attached to a bench. The bench and monolith are attached to a base. The rotation of the lower body exerciser is translated into linear movement by a series of sprockets and timing belts. The speed, direction and position of the arm and lower body exerciser are determined by a potentiometer and the amount and direction of force being exerted on the arm and lower body exerciser are determined by a load cell. The electrical output of the load cells and potentiometers are processed as feed back in the electronic controls. The arm is articulating and has handles which may pivot with respect to the arms and arms which may pivot with respect to the arm lever. The arm lever may pivot with respect to the monolith. Therefore, there are five separate axes of rotation to configure the arm to accommodate the physique of the user. The arms pivot in mirror relationship and are linked so that the pivoting of one arm results in the mirror pivoting of the other. The lower body exerciser may be lengthened or shortened to accommodate the individual users' physique.

These objects are further realized in an automatic force generating control system which employs solenoid clutches to engage the handles to the arms and the arms to the head.

These objects are further realized in an automatic force generating control system which employs a mechanical linkage to transmit movement of the lower body exerciser to the arm, thereby negating the need for a second hydraulic system.

BRIEF DESCRIPTION OF THE DRAWINGS

FIG. 4 is a top view of the automatic force generating and control system of FIG. 1.

FIG. 5 is a front view of the automatic force generating and control system of FIG. 1.

FIG. 6 is a back view of the automatic force generating and control system of FIG. 1.

FIG. 20 is a partial cross section of the solenoid clutch assembly of FIG. 19 when unenergized.

FIG. 21 is a partial cross section of the solenoid clutch assembly of FIG. 19 when energized.

FIG. 22 is a front view of the male clutch of FIG. 21 in partial phantom.

FIG. 23 is a front view of the female clutch of FIG. 21.

FIG. 24 is a partial cross section of the handle of the clutch assembly of FIG. 19.

FIG. 46 is a view of the contact blocks of the system of FIG. 1

FIG. 48 is a partial cut-away view of the notch of the system of FIG. 1.

FIG. 49 is a schematic view of an alternate embodiment, including a linkage system, for the system of FIG. 1.

FIG. 50 is a right side view of the lower body exerciser portion of the alternate linkage system of FIG. 49.

FIG. 51 is a right side view of the lower body exerciser portion of the alternate linkage system of FIG. 49.

FIG. 52 is a right side view of the lower body exerciser portion of the alternate linkage system of FIG. 49.

FIG. 53 is a right side view of the lower body exerciser portion of the alternate linkage embodiment of FIG. 49.

DETAILED DESCRIPTION OF THE PREFERRED EMBODIMENT

Figure 1:
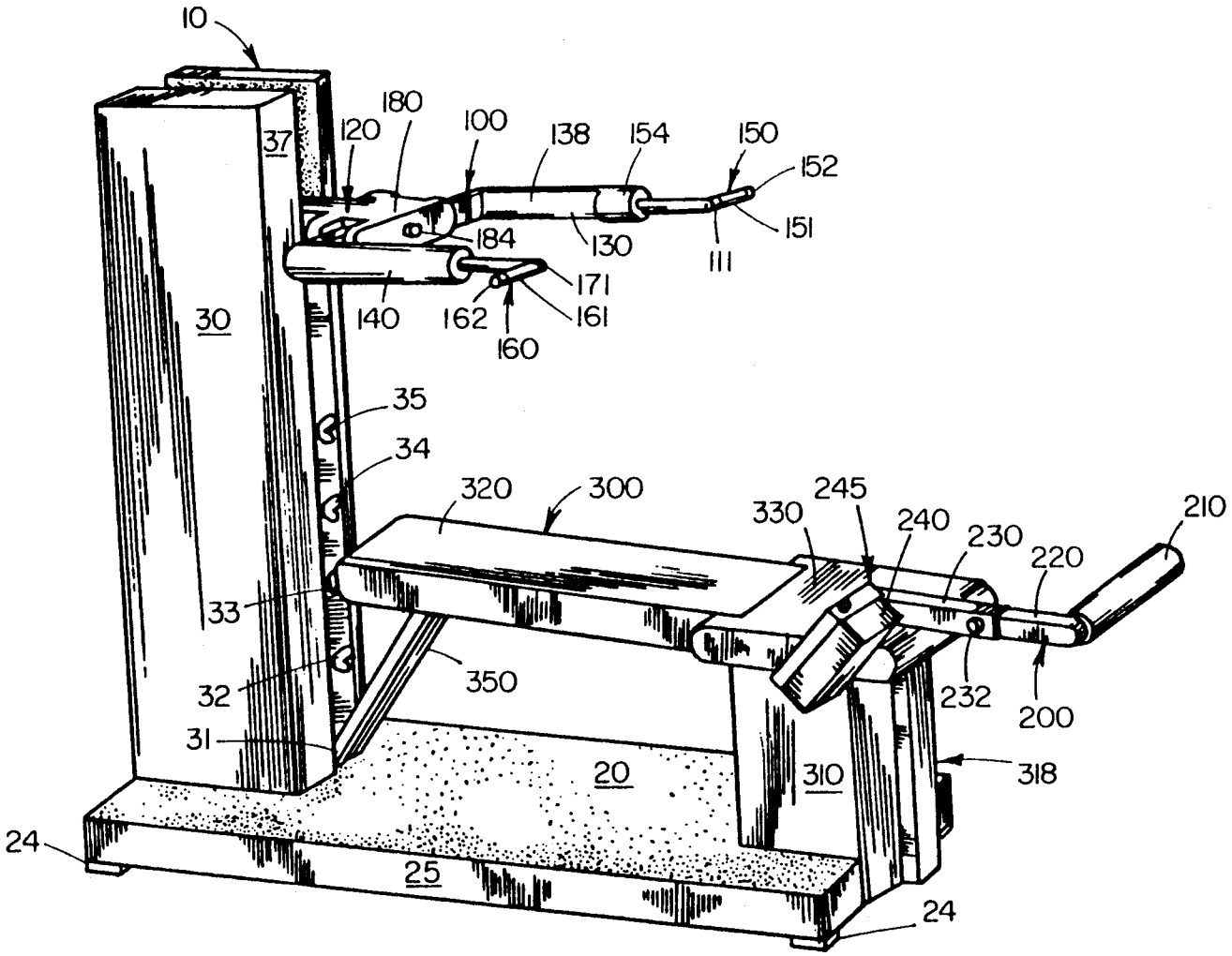
FIG. 1 is a perspective view of a preferred embodiment of the automatic force generating and control system according to the present invention.

Referring now to the drawings wherein like reference numerals correspond to like parts throughout, there is shown in FIG. 1 an automatic force generating and control system 10 having a monolith 30, a platform 20, a lever 100, a lower body exerciser 200 and a bench 300. The monolith 30, platform 20 and bench 300 remain substantially stationary with respect to the user during exercise and are generally referred to as the base 25. The lever 100 includes a beam 120, a head 180, a first, L-shaped arm 130, a second, L-shaped arm 140, a first handle 150 and a second handle 160. The handle 150 has buttons 152 and 111. The second handle 160 has buttons 162 and 171. The arm 130 has a flat surface 138 and a padded, rounded end 154 and the arm 140 has a flat surface 148 and a padded, rounded end 156 (see FIG. 4).

The monolith 30 which may also be referred to as an upright member, stands perpendicular to the platform 20 and houses the lever 100 which extends outward from the monolith above the bench 300. The monolith has notches 31, 32, 33, 34 and 35 on its front, outer surface 37. The platform 20 has four adjustable levelers, 24, one each at the corners.

Figure 45:
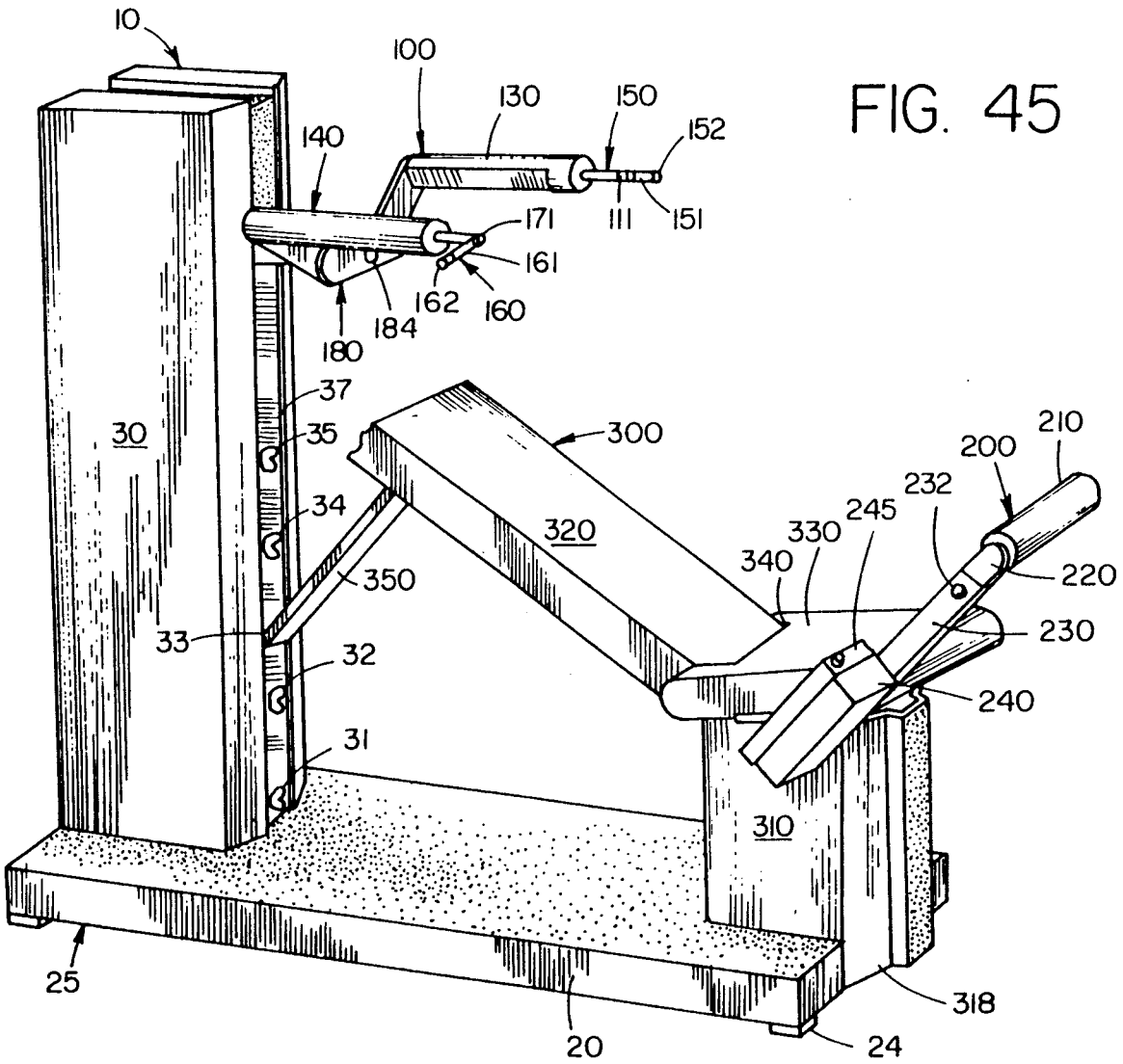
FIG. 45 is a perspective view of the automatic force generating and control system of FIG. 1 configured to perform another exercise, such as an inclined bench press.
Figure 47:
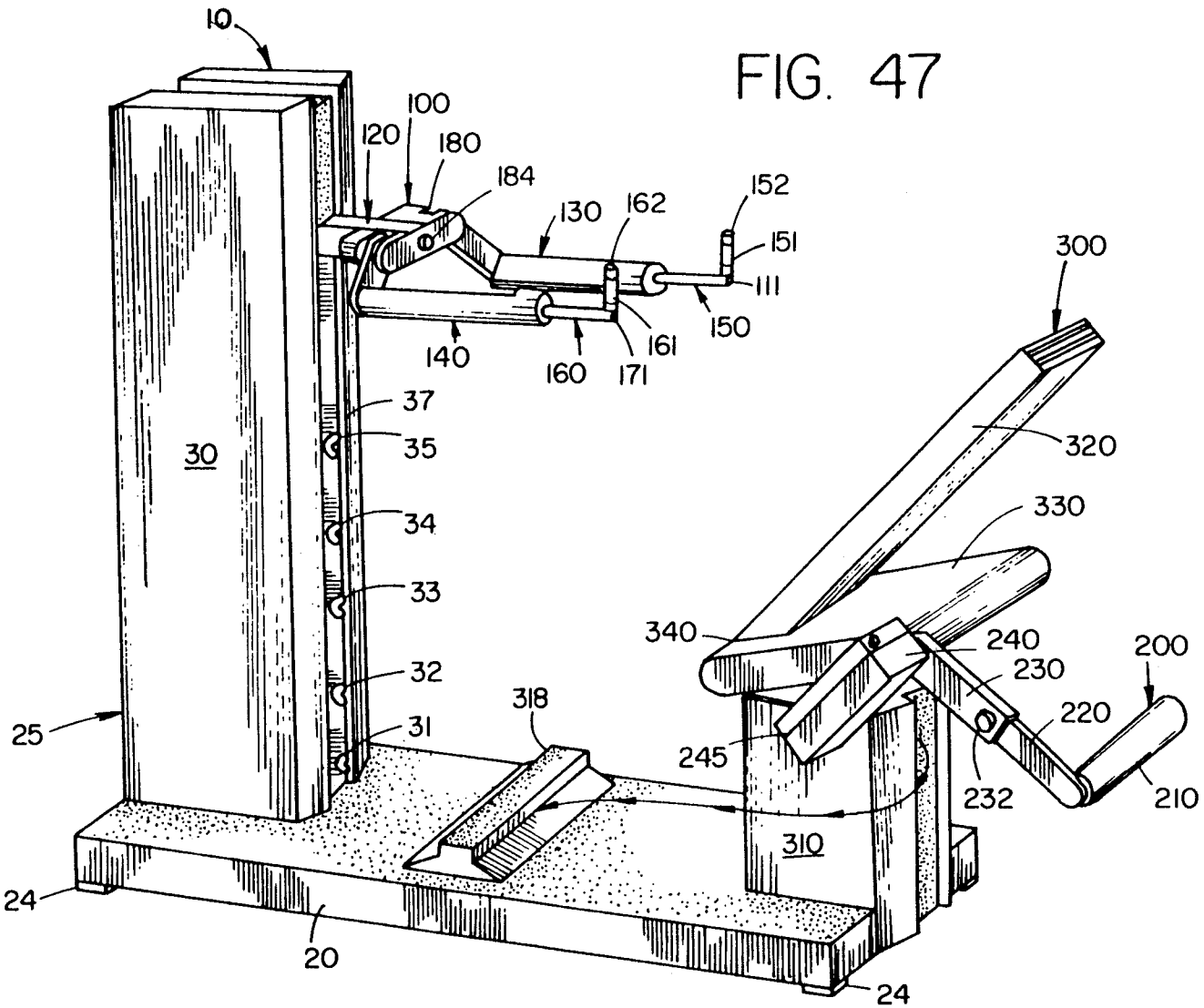
FIG. 47 is perspective view of the automatic force generating and control system of FIG. 1 configured to perform another exercise, such as a hip flexor.

The bench 300 includes the seat 330, the inner bench portion 320, the seat base 310, and the inner bench portion stand 350. The toe raise block 318 is positioned on the outer side of base 310. The inner bench portion 320 and seat 330 pivot around the hinge-type joint 340. Thus, the inner bench portion 320 can be pivoted upon the hinge 340 to enable the user to recline at various angles with respect to the ground while exercising. The inner bench portion stand 350 may be positioned within one of the notches 31, 32, 33, 34 or 35 to achieve the desired angle. FIG. 45 shows the stand 350 positioned within the notch 33. In the alternative, the portion 320 can be pivoted fully away from the monolith 30 and thereby positioned away from the lever 100 to enable the user to stand upon the platform 20 unencumbered by the bench 300 while exercising. FIG. 47 shows the portion 320 so positioned. In the position shown in FIG. 47, the portion 320 is approximately sixty degrees with respect to the ground.

The lower body exerciser 200 includes the lower body exerciser bar 210, the outer leg extension bar 220, the inner leg extension bar 230, and the sprocket housing 240. The display/printer 245 is positioned on top of the housing 240.

Figure 2:
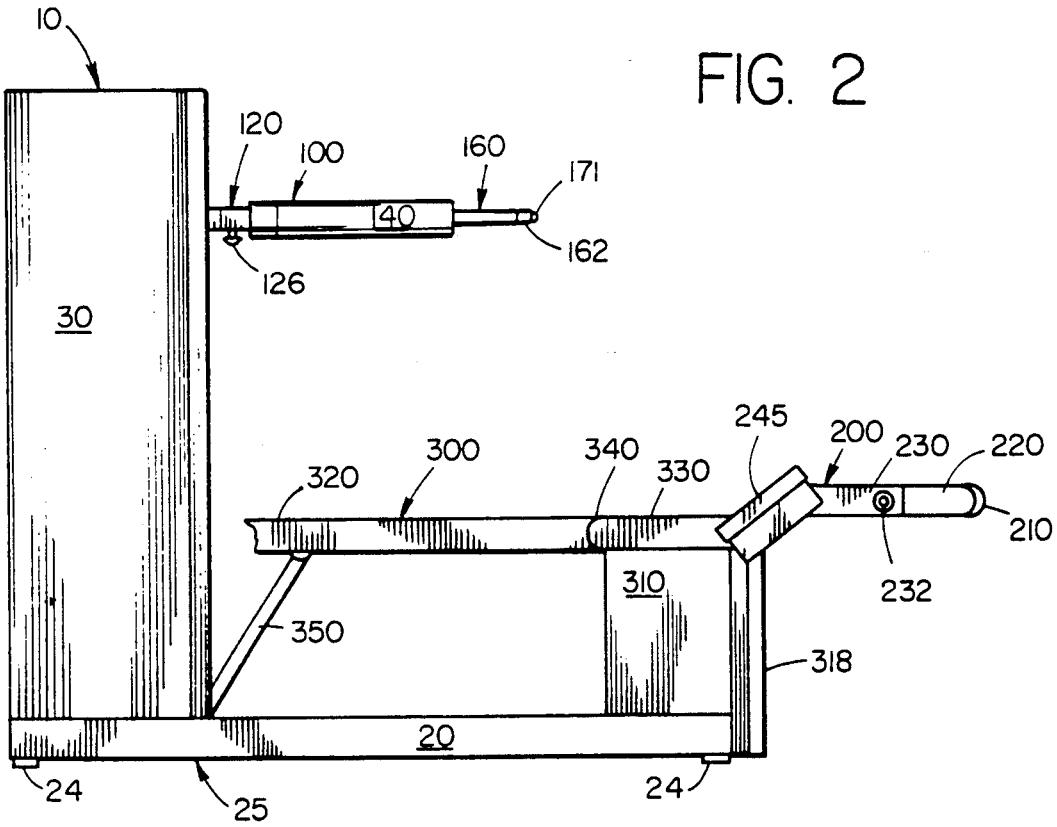
FIG. 2 is a right side view of the automatic force generating and control system of FIG. 1.

FIG. 2 is a view of the right side of the automatic force generating and control system 10. The clamp 232 is shown on the side of the inner leg extension bar 230. The emergency stop button 126 is positioned below the beam 120.

Figure 3:
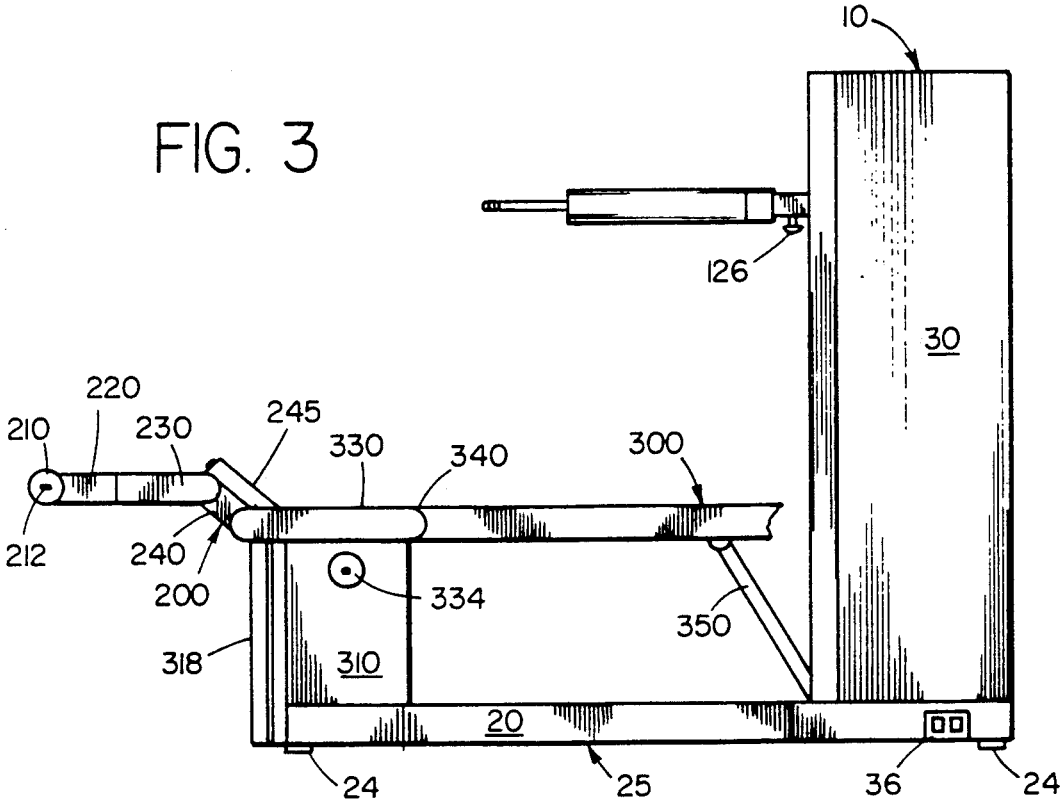
FIG. 3 is a left side view of the automatic force generating and control system of FIG. 1.

FIG. 3 is a left side view of the automatic force generating and control system 10. The seat adjustment knob 334 is shown on the side of base 310. The on/off switch and key switch 36 is shown on the platform 20. The recessed eyelet 212 on the bar 210 is shown in FIG. 3. The user may attach leg cuffs to the eyelet 212 during exercise.

FIG. 4 is a top view of the automatic force generating and control system 10.

FIG. 5 is a front view of the automatic force generating and control system 10. The button 184 which enables the arms 130 and 140 to be pivoted with respect to the head 180 can be seen in this view.

FIG. 6 is a back view of the automatic force generating and control system 10.

Figure 7:
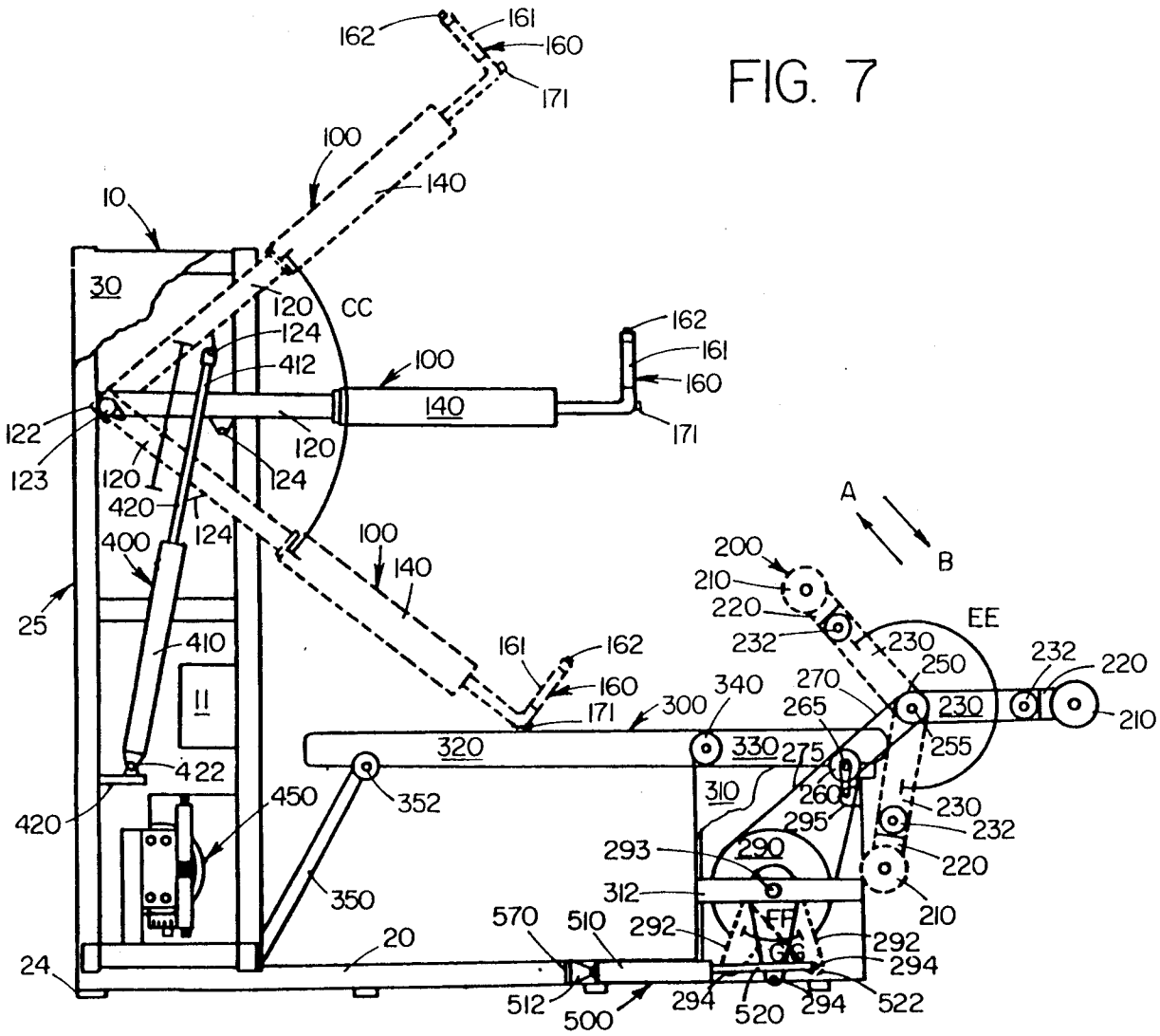
FIG. 7 is a partial cutaway side view of the automatic force generating and control system of FIG. 1.

FIG. 7 is a partial cutaway view from the right side of the automatic force generating and control system 10. The monolith 30 is made up of an essentially hollow structure which houses the beam 120, the arm hydraulics 400 and power amplification and electronic controls 11. The arm hydraulics 400 include the cylinder 410, the rod 420, and the manifold/pump/motor 450. The present invention is directed to the mechanical aspects of the force generating and control system. Details regarding the electronic controls, hydraulics and design of the system are set forth in applicants' co-pending U.S. patent application Ser. No. 07/435,827, entitled "Automatic Force Generating and Control System", filed on Nov. 13, 1989, U.S. patent application Ser. No. 07/439,932, entitled "Automatic Force Generating and Control System", filed on Nov. 13, 1989, and U.S. Design patent application Ser. No. 07/434,831, entitled "Automatic Force Generating and Control System", and filed on Nov. 13, 1989, respectively, which are incorporated herein by reference. To the extend necessary, those incorporated applications will be referred to in the context of the ensuing description.

The rod 420 is pivotally connected to the lever 100 by arm linkage 412 which is connected to clevis 124 of the beam 120. The beam 120 pivots upon the pivot 122. The lever 100 may pivot through a total of eighty degrees comprising 40 degrees above horizontal and 40 degrees below horizontal. The arm hydraulics 400 and the length of the stroke of the rod 420 are dimensioned to accommodate the eighty degree stroke. The manifold-/pump/motor 450 is connected to the cylinder 410 to regulate the resistance to movement of the arm during exercise as described below. Either the button 162 or the button 152 is used by the user to set the start position of the lever 100 for the desired exercise as described below. The button 171 is used by the operator to determine the position of the handle 160 with regard to the arm 140 and the button 111 is used by the operator to determine the position of the handle 150 with regard to the arm 130 as described below.

FIG. 7 also shows the lower body exerciser 200. The sprocket housing 240 has been removed in FIG. 7 for clarity. The lower body exerciser bar 210 has a total stroke of 240 degrees which is approximately 10 degrees past vertical at the bottom of the stroke to approximately 50 degrees past vertical at the top of its stroke. The clamp 232 when loosened enables the operator to move the outer leg extension bar 220 either into or away from the inner leg extension bar 230, shown as directions A and B in FIG. 7, so as to enable the operator to set the desired length of the leg exercise bar 210 from the first rotating shaft 255. This provides infinite adjustment of the combined length of bars 220 and 230 in the operating range. When the desired length is achieved the clamp 232 is tightened by the operator and the outer bar 220 is firmly positioned with respect to the inner bar 230.

Figure 8:
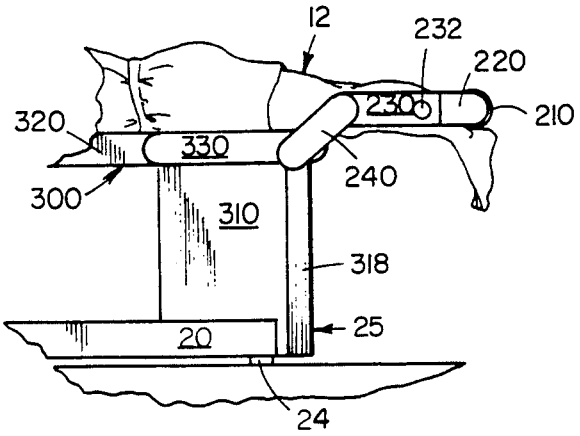
FIG. 8 is a right side view of the lower body exerciser of the system of FIG. 1 in use.
Figure 9:
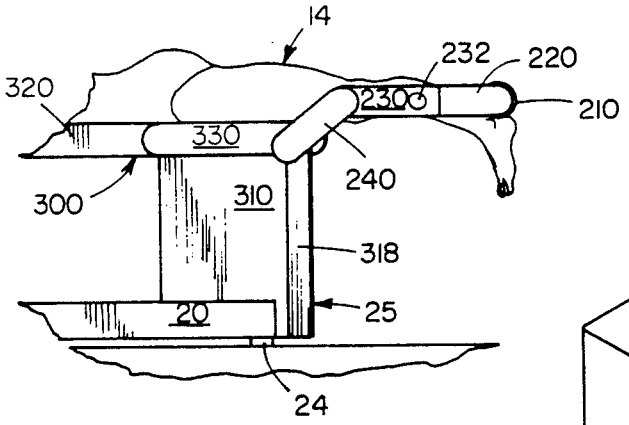
FIG. 9 is another right side view of the lower body exerciser of the system of FIG. 1 in use.

FIGS. 8 and 9 show the adaptability of the bars 220 and 230 to accommodate different sized individuals. In FIG. 8 the man 12 has adjusted the bar 220 to be substantially retracted into the bar 230 to accommodate his relatively short legs. Note that the knees of the man 12 are lined up with the axis of rotation of the bar 230, thereby assuring that the movements of the bar 230 will closely track the movements of the man's calves as the knees are bent.

In FIG. 9 the woman 14 has adjusted the bars 220 and 230 to accommodate her relatively long legs. Specifically, the bar 220 has been substantially extended out of the bar 230. Note also that the knees of the woman 14 substantially align with the axis of rotation of the bar 230 around the stationary sprocket housing 240. As shown in FIGS. 8 and 9 the combined length of the bars 220 and 230 may be adjusted to accommodate the physique of the user for any given exercise.

During exercise the operator pivots the exercise bar 210 around the first rotating shaft 255. This rotation is transmitted to the rotating shaft 255. The shaft 25 is located above and away from the seat 330 with regard to the monolith 30. Thus, the axis of the first rotating shaft 255 may be aligned with the operator's knee so that the rotation of the exercise bar 210 by the operator exercises the operator's knee. The rotation of the first rotating shaft 255 is transmitted to the first sprocket 250 which rotates in the same direction and turns the first timing belt or chain 270. The first timing belt 270 is tautly connected to the second sprocket 260 which, in turn, is rotated in the same direction as the first sprocket 250. The second sprocket 260 is connected to the second rotating shaft 265 so that rotation of the second sprocket 260 also rotates the second rotating shaft 265.

A third sprocket 280, positioned on the second rotating shaft 265 (see FIG. 44), is also rotated. The third sprocket 280 when rotated also rotates a second timing belt or chain 275 which is tautly connected to a fourth sprocket 290. A crank arm 292 is connected to the center of the fourth sprocket 290 and extends past its circumference. Thus, rotation of the exercise bar 210 is transmitted through the first rotating shaft 255, the first sprocket 250, the first timing belt 270, the second sprocket 260, the second rotating shaft 265, the third sprocket 280, the second timing belt 275, and the fourth sprocket 290.

At this point the rotation is transmitted to the crank arm 292. The elements of the lower body exerciser are dimensioned so that the first sprocket 250, the second sprocket 260, and the third sprocket 280 are each of the same size and have a circumference which is approximately one-fourth that of the fourth sprocket 290. Thus, the 240 degrees of total stroke for the leg exercise arm 210 translates to a total stroke of 60 degrees of the crank arm 292.

The leg hydraulics 500 include the cylinder 510, the rod 520, and the manifold/pump/motor 450. The cylinder 510 is pivotally connected to the platform 20 by clevis 512. The rod 520 is pivotally connected to the crank arm 292 by clevis 522. Thus, rotation of the fourth sprocket 290 is transmitted to linear movement of the rod 520 with regard to the cylinder 510. In this way, selective resistance in the cylinder 510 by the leg hydraulics 500 is transmitted to the operator when he goes to pivot the exercise bar 210 around the first rotating shaft 255, as described below.

FIG. 7 also shows how the system 10 is capable of gathering data concerning the location, direction, speed and force at which the user is exercising. As shown in FIG. 7, lever 100 pivots around pivot 122. The total arc of stroke, designated as CC in FIG. 7, is approximately 80 degrees. The rod 420 of the arm hydraulics 400 is pivotally connected to the lever 100 at pivot 124, and accordingly, when the lever 100 is pivoted, the rotational movement is translated to linear movement of the rod 420 into the cylinder 410. The 80 degrees of arc CC is translated into approximately 12 inches of stroke DD of the rod 420 as shown in FIG. 7. The potentiometer 123 is connected to the lever 100 and is capable of determining the location of the lever 100 within its stroke CC. This information may be sent electronically to the electronic controls 11 also shown in FIG. 7. By comparing the locations of the lever 100 over time, the speed and direction of the lever 100 within its stroke CC may be determined by the electronic controls 11.

Figure 10:
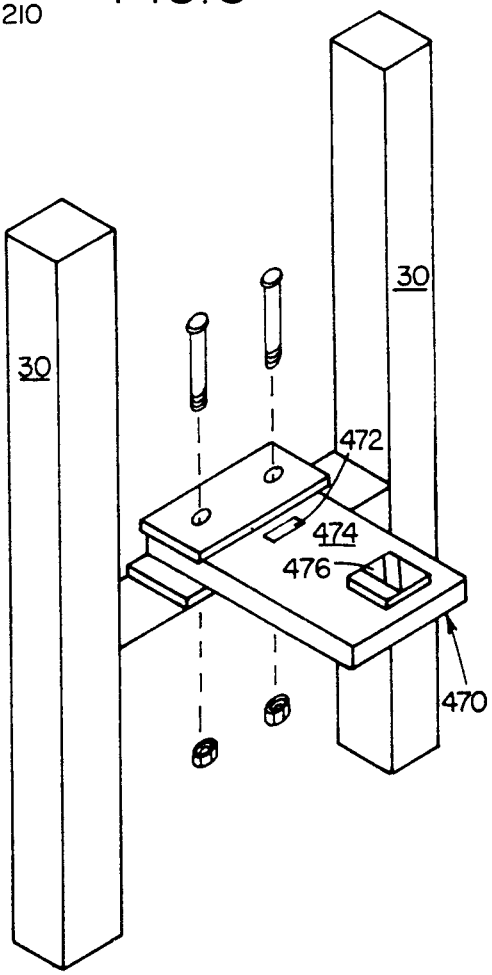
FIG. 10 is a perspective view of the load cell of the system of FIG. 1.

FIG. 7 shows that the cylinder 410 is mounted to the monolith 30 by load cell 470. As shown in FIG. 10 load cell 470 is a cantilever beam 474 attached to the monolith 30 at one end and having a mount 476 at the other end with an upper strain gauge 472 positioned in the middle. A lower strain gauge is positioned on the underneath side of the cantilever beam 474. The mount 476 is connected to the clevis 422 of the arm cylinder 410. Thus, as force is exerted along rod 420, it is translated to the load cell 470 which slightly deflects, depending on the direction and amount of force. Specifically, if the force is down into the cylinder 410, the load cell 470 will flex down towards the ground, and if the force is up through from the cylinder 410, then the load cell 470 will deflect slightly upwards. Thus, one strain gauge will be in compression while the other strain gauge will be in tension. The amount and direction of deflection is translated into electronic signals by the strain gauges which are sent to electronic controls 11. Therefore, the load cell 470 enables the electronic controls 11 to determine the amount of force being exerted upon the arm hydraulics 400 and the direction of the force. Thus, through the use of the potentiometer 123 and the load cell 470 the electronic control 11 is capable of determining the amount of force being exerted by the user upon the lever 100, the location of the lever 100 within its stroke, the speed of the lever 100 and the direction of movement of the lever 100.

The leg exercise bar 210 has approximately a 240 degree stroke designated as EE in FIG. 7. As described above, this rotation is translated into approximately 60 degrees of stroke for the crank arm 292 around pivot 293. The 60 degree stroke of crank arm 292 is designated as FF in FIG. 7. The rod 520 of the leg hydraulic 500 is pivotally connected to the crank arm 292 and the 60 degree stroke of the crank arm 292 is translated into linear movement of the rod 520 into and out of the cylinder 510. Note that the cylinder 510 is pivotally connected to the platform 20 by clevis 512. The stroke of rod 520 is approximately 8 inches and is designated as GG in FIG. 7.

A potentiometer 295 is mounted to the second rotating shaft 265 enables the electronic controls 11 to determine the location of the bar 210 within its stroke EE. By comparing locations over time, the electronic controls 11 can determine the direction of movement and the speed of movement of the bar 210 within its stroke.

Because the cylinder 510 is mounted upon a load cell 570, the electronic controls are capable of determining the force and direction being felt by the cylinder 510. Load cell 570 is similar to the construction and function of load cell 470. The cantilever beam in the load cell 570 is positioned within the platform 20 and is deflected either towards or away from the monolith 30. The cantilever beam in load cell 570 extends across the platform 20 parallel to the ground. If the force being felt by the cylinder 510 is to the left hand side (towards the monolith 30), then the cantilever will deflect to the left hand side. This results in an electronic signals from the strain gauges in load cell 570 which are sent to the electronic control 11. Similarly, if the cylinder 510 is feeling a force to the right hand side, the cantilever 570 will deflect slightly to the right and electronic signals containing this information will be sent to the electronic control 11. Thus, through the use of the potentiometer 295 and load cell 570 the electronic control 11 is capable of determining the amount of force being exerted by the user upon the bar 210, the location of the bar 210 within its stroke, the speed of the bar 210 and the direction of movement of the bar 210.

Figure 11:
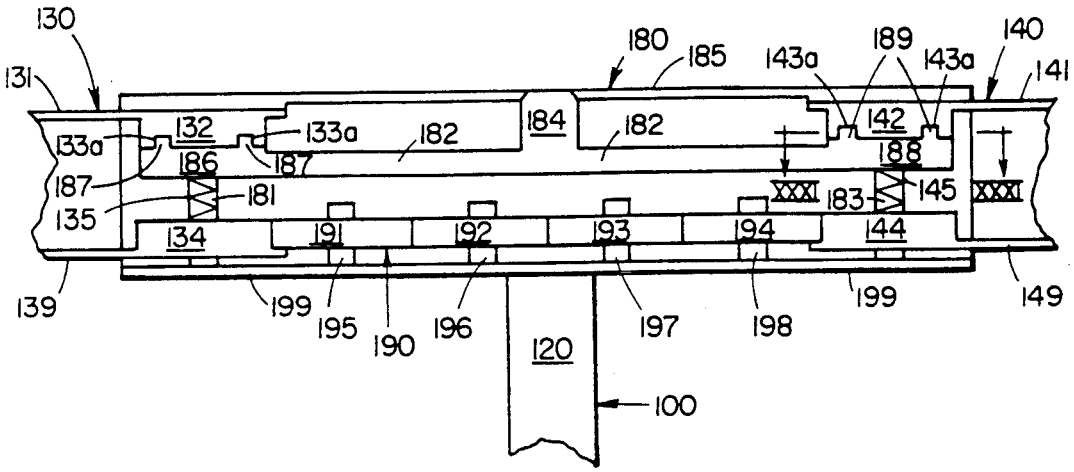
FIG. 11 is a cross sectional view of the head and arms of the automatic force generating and control system of FIG. 1.

FIG. 11 shows the clutch mechanism in the head 180 whereby the arms 130 and 140 may be pivoted with respect to the head 180 and positioned firmly with respect to the head 180. This enables the operator to position the arms 130 and 140 in a configuration most comfortable to the operator's physique and appropriate for the exercise desired. The head 180 consists of an essential hollow housing with a front plate 185 and a back plate 199. The arms 130 and 140 are positioned on either side of the head 180. The arms 130 and 140 may be pivoted with respect to the head 180 by pivot shafts 181 and 183, respectively.

The head 180 is firmly connected to the beam 120 of the lever 100.

In FIG. 11 the arms 130 and 140 are firmly connected to the head 180 and cannot pivot with respect to the head 180. This is due to the fact that the head clutch plate 182 is forced against the head clutch face 132 of the arm 130 by the spring 135 and the clutch face 188 of the head clutch plate 182 is forced against the head clutch face 142 of the arm 140. In this position, the clutch pins 187 of the face 186 are housed within the pin holes 133A. Thus, the arm 130 cannot pivot with regard to the clutch face 186 around the pivot shaft 181. Similarly, the pins 189 of the clutch face 188 are positioned firmly within the pin holes 143A of the face 142 of the arm 140. Thus, the arm 140 cannot be pivoted around the pivot shaft 183.

Figure 12:
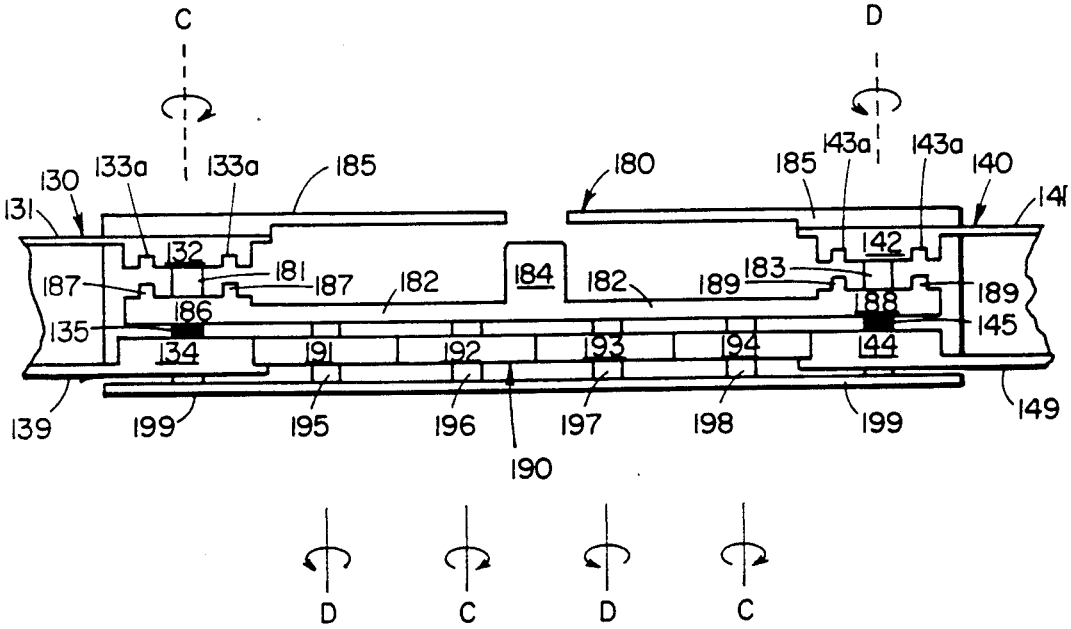
FIG. 12 is a cross sectional view of the head of the automatic force generating and control system of FIG. 1 wherein the head clutch plate has been disengaged from the arms.

FIG. 12 shows how the clutch plate 182 is disengaged from the faces 132 and 142 thereby enabling the arms 130 and 140 to be pivoted with respect to the head 180. Also, FIG. 12 shows how the rotation of one arm is transmitted to the other so that the operator need only move one arm to position both arms. The beam 120 has been removed from FIGS. 12–14 for clarity.

Refer now to FIG. 12 where the operator has moved the button 184 into the interior of the head 180. The pins 187 are thereby moved out of contact with the pin holes 133A. Similarly, the pins 189 are moved out of contact with the pin holes 143A. The operator then may pivot the arm 130 around the pivot 181 in the direction C. In doing so, the operator also turns the circular gear 134 of the arm 130 around the pivot shaft 181. This causes the first circular gear 191 of the gear assembly 190 to turn around its pivot 195 in the direction D. This, in turn, causes the second circular gear 192 to turn around its pivot 196 in the direction C. This, in turn, causes the third circular gear 193 to turn around its pivot 197 in the direction D. This, in turn, causes the fourth circular gear 194 to turn around its pivot 198 in the direction C. This, finally, causes the circular gear 144 of the arm 140 to pivot around its pivot 183 in the direction D. Because each of the gears 134, 144, and 191, 192, 193 and 194 are of the same size and interlock, the arms 130 and 140 pivot through the same arc of rotation and in the opposite direction.

Figure 13:
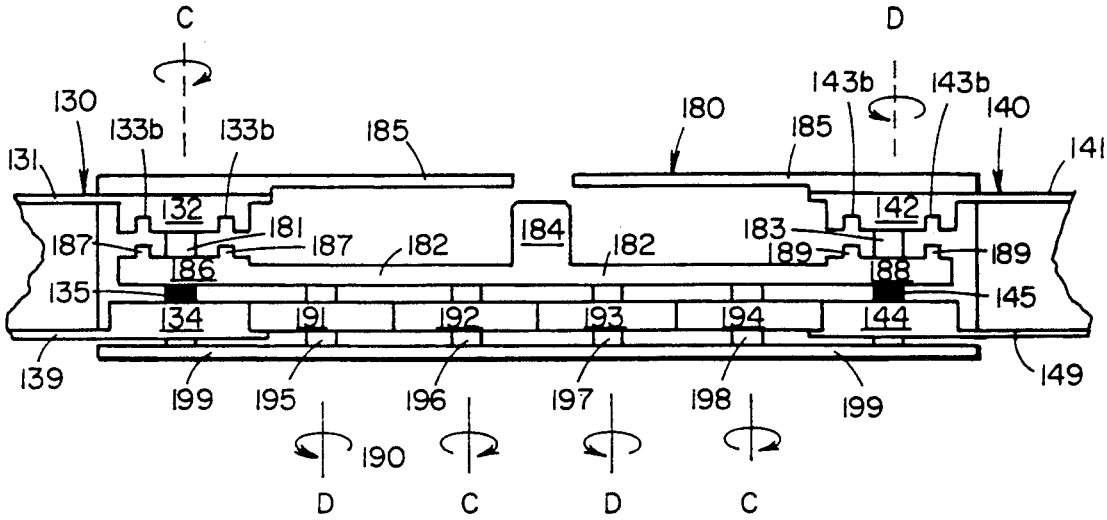
FIG. 13 is a cross sectional view of the head of the automatic force generating and control system of FIG. 1 wherein the head clutch plate is disengaged and the arms have been rotated with regard to the head.

FIG. 13 shows the arm 130 having been rotated in the direction C to the desired position by the operator wherein the pivot holes 133B of the face 132 now align with the pins 187. At this point, the pin holes 143B also align with the pins 189. Each of the clutch faces 186 and 188 have eight pins 187 and 189 respectively positioned at 45 degrees around their circumference. Each of the clutch faces 132 and 142 have 24 pin holes spaced equally at 15 degrees around their circumference. Thus, discrete rotations of 15 degrees between the arms 130 and 140 and the head 180 are possible. Different numbers of pins and pin holes may be used to obtain different angles for different machines and uses.

Figure 14:
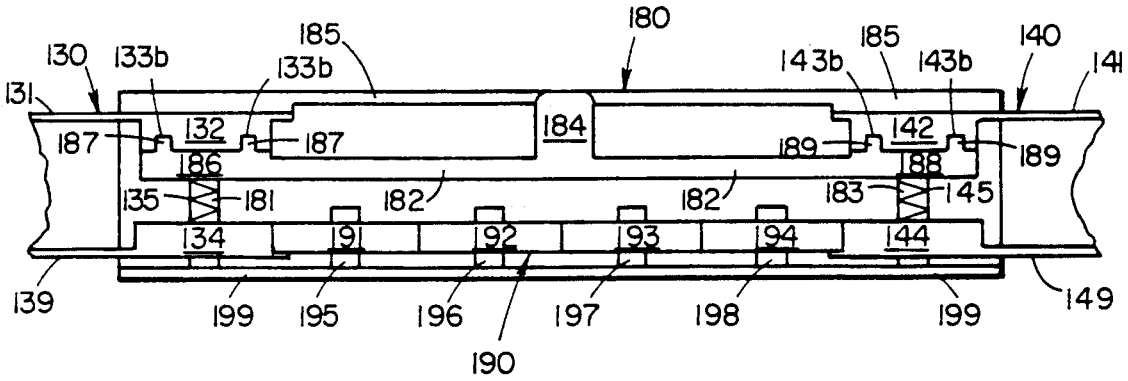
FIG. 14 is a cross sectional view of the head of the automatic force generating and control system of FIG. 1 wherein the head clutch plate has been reengaged to the arms in their now rotated position.

FIG. 14 shows the head 180 in firm engagement with the arms 130 and 140 at the new desired position. The operator has disengaged the button 184 and the springs 135 and 145 have moved the clutch plate 182 into firm engagement with the arms 130 and 140. Specifically, the pins 187 of the face 186 are in firm engagement with the pin holes 133B of the face 132. Similarly, the pins 189 of the face 188 are in firm engagement with the pin holes 143B of the face 142. In this position, the arms 130 and 140 cannot pivot with respect to the head 180.

While FIGS. 12 and 13 show arm 130 pivoting in the C direction and arm 140 pivoting in the D direction, the arms may also pivot in the opposite direction with the arm 130 pivoting in the D direction and the arm 140 pivoting in the C direction.

Figure 15:
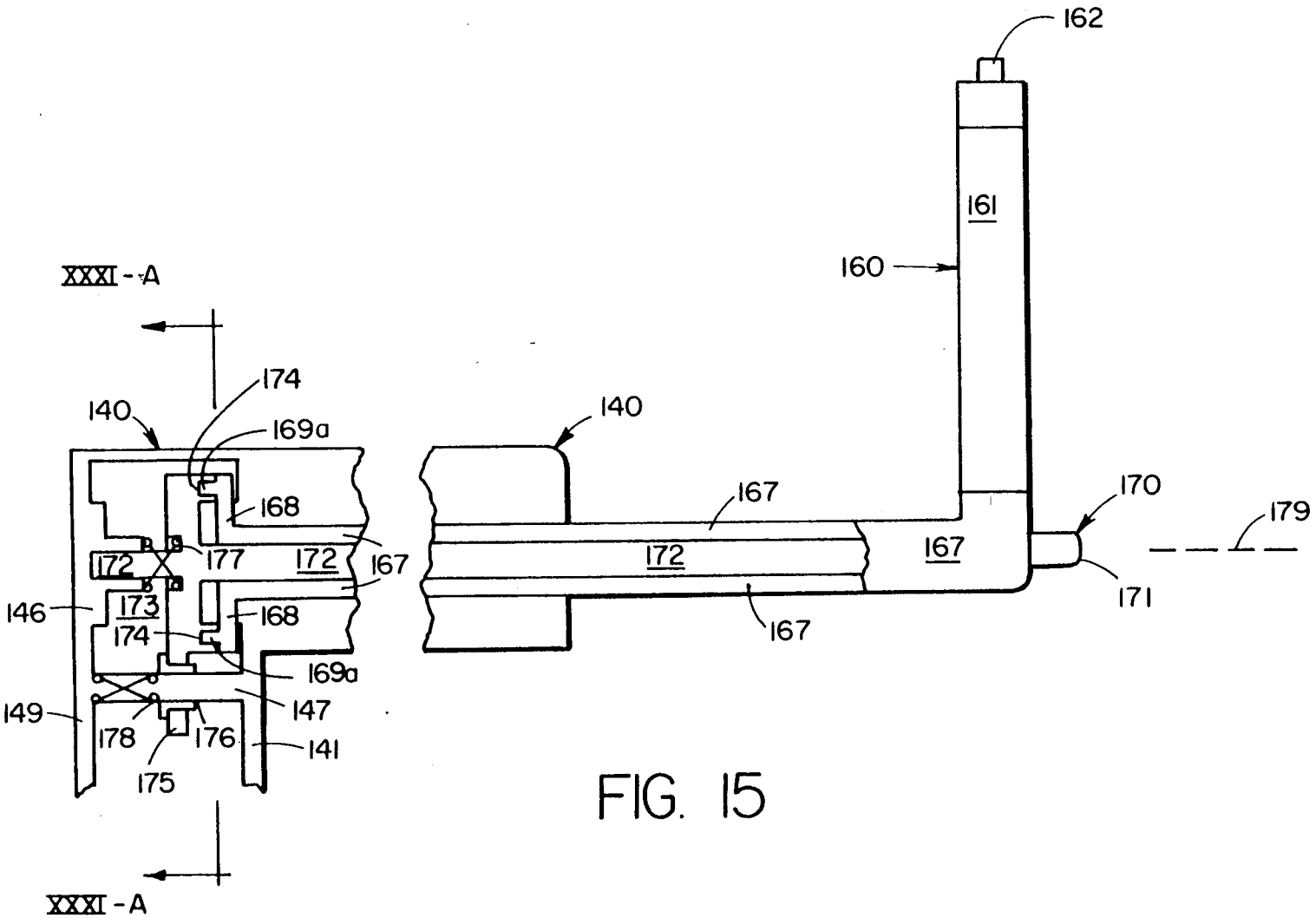
FIG. 15 is a partial cross sectional view of a arm of the automatic force generating and control system of FIG. 1.

FIG. 15 is a partial cross sectional view of the handle/arm clutch assembly 170. This clutch assembly 170 enables the handle 160 to be pivoted with respect to the arm 140 in a plane perpendicular to the axis of the rod 172. This enables the operator to position the handle in the desired position conducive to the operator's physique for a particular exercise.

FIG. 15 shows the handle 160 firmly positioned with respect to the arm 140 in a 90 degree relationship pointing straight up the page. The handle 160 is firmly engaged to the arm 140 because the clutch face 168 of the handle 160 is firmly engaged to the clutch face 173 of the arm 140. The clutch face 168 is connected to the handle 160 by the handle shaft 167. The shaft 167 is cylindrical and hollow in its center and the rod 172 of the assembly 170 is positioned within the shaft 167 and extends from either end of the shaft 167. The shaft 167 may be coated or covered over its exposed portion with rubber, foam, plastic or other suitable material. In the right hand side of FIG. 15 the rod 172 extends outside of the shaft 167 thereby forming the button 171. In the left hand side of FIG. 15 the rod 172 extends past the shaft 167 and is connected to the clutch face 173. The rod 172 also extends into the guide socket 146 which is connected to the back side 149 of the arm 140. A spring 177 is positioned between the back of the clutch face 173 and the guide socket 146 to force the clutch face 173 into engagement with the clutch face 168. When the two clutch faces 168 and 173 are in engagement as shown in FIG. 15, the pins 169A of face 168 are firmly positioned within the pin holes 174 of the face 173. When this occurs, the shaft 167 cannot be rotated around the rod 172.

The rod 172 and face 173 are firmly positioned with respect to the arm 140 by the rod 147 which is connected to the front side 141 and the back side 149 of the arm 140. The assembly 170 also includes a flange 175 which extends around the rod 147. Specifically, the flange 175 has a hole 176 through which the rod 147 is positioned. This restricts movement of the flange 175 and the assembly 170 in a linear direction along the axis of the rod 147. The axis of the rod 147 is parallel to the axis of the socket 146, the shaft 167 and the rod 172 (the axis of the rod 172 is shown as 179 in FIG. 15) as well as the pins 169A and the pin holes 174. Thus, the assembly 170 as shown in FIG. 15 may not pivot with respect to the arm 140 because the clutch face 173 is firmly secured to the clutch face 168 and the flange 175 may not pivot against the rod 147. In this position the handle 160 is firmly positioned with respect to the arm 140.

FIG. 15 also shows the handle rotating surface 161. The surface 161 may be coated with rubber, foam, plastic or other suitable surface. The surface 161 is the portion that the user will normally grip while exercising. The surface 161 is cylindrical and may rotate around its long axis to avoid any slippage between the user's hand and the handle 160 as the lever 100 is pivoted by the user through its stroke CC (see FIG. 7). Handle 150 has a similar surface 151.

Figure 16:
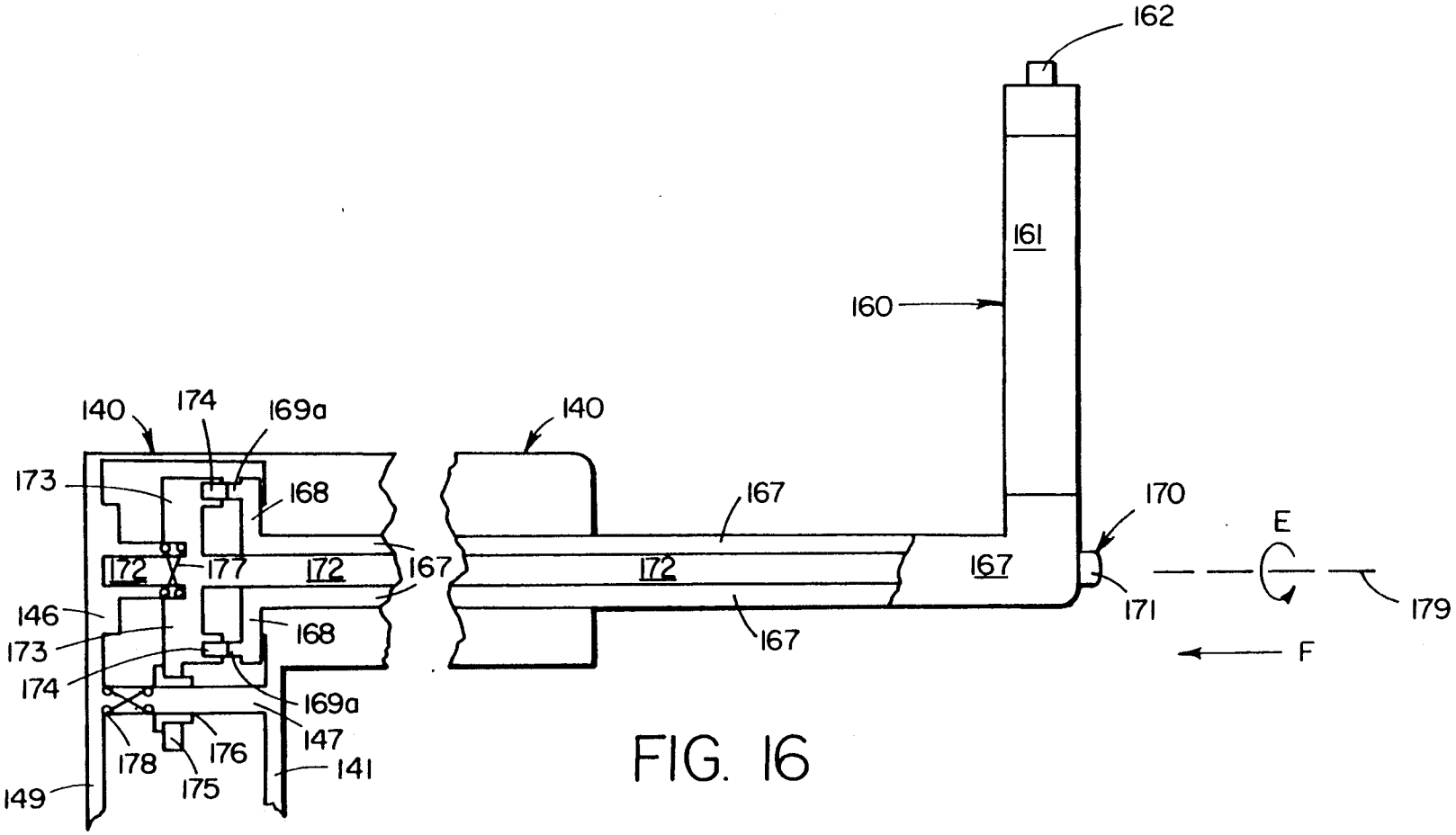
FIG. 16 is a partial cross sectional view of the automatic force generating and control system of FIG. 1 wherein the handle arm clutch assembly has been disengaged from the handle.

FIG. 16 shows the clutch face 173 in a disengaged position from the clutch face 168. Thus, the handle 160 is free to be rotated in the E direction around the axis 179 and the operator may position handle 160 with respect to the arm 140 to the desired position. To disengage the assembly 170 from the handle 160, the operator pushes the button 171 in the direction F shown in FIG. 16. This moves the clutch face 173 away from the clutch face 168 thereby moving pin holes 174 out of engagement with the pins 169A. In this position the handle 160 may be rotated around the axis 179. The rod 172 is moved further into the socket 146 in the direction F and the flange 175 is moved in the direction F down the rod 147. The springs 177 and 178 are thereby compressed.

The pins 169 and pin holes 174 are similar in configuration to the pin holes 133 and pins 187 in the head clutch as assembly. Specifically, there are 8 pins 169 equally spaced along the circumference of the face 168 at 45 degrees to each other. There are 24 pin holes 174 equally spaced along the circumference of the face 173 at 15 degrees to each other. Thus, the handle 160 may be rotated at discrete angles of 15 degrees with respect to the arm 140. Thus, when the clutch face 168 is engaged to the clutch face 173 each third pin hole 174 houses a pin 169. Other number of pins and pin holes may be used for different machines and applications.

Figure 17:
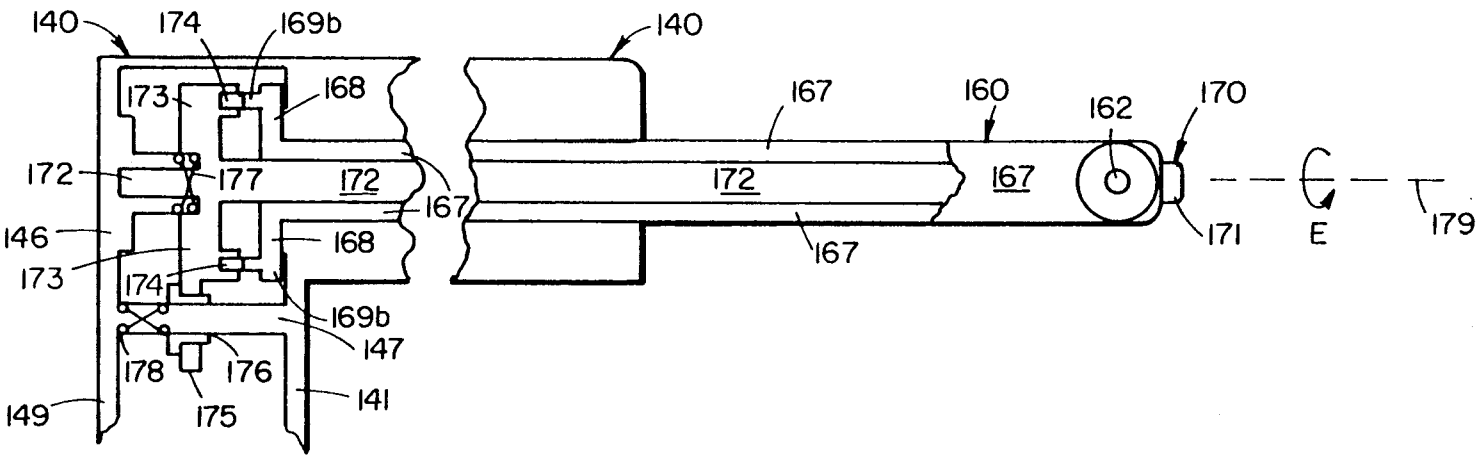
FIG. 17 is a partial cross sectional view of a arm of the automatic force generating and control system of FIG. 1 wherein the handle has been rotated 90 degrees.

FIG. 17 is a partial cutaway view of the handle 160 having been rotated 90 degrees about the axis 179 so that the handle stem is positioned pointing directly out of the page. This is the position desired by the operator. The clutch face 168 has also been rotated 90 degrees in the direction E so that a new set of pins 169B now align with the pin holes 174.

Figure 18:
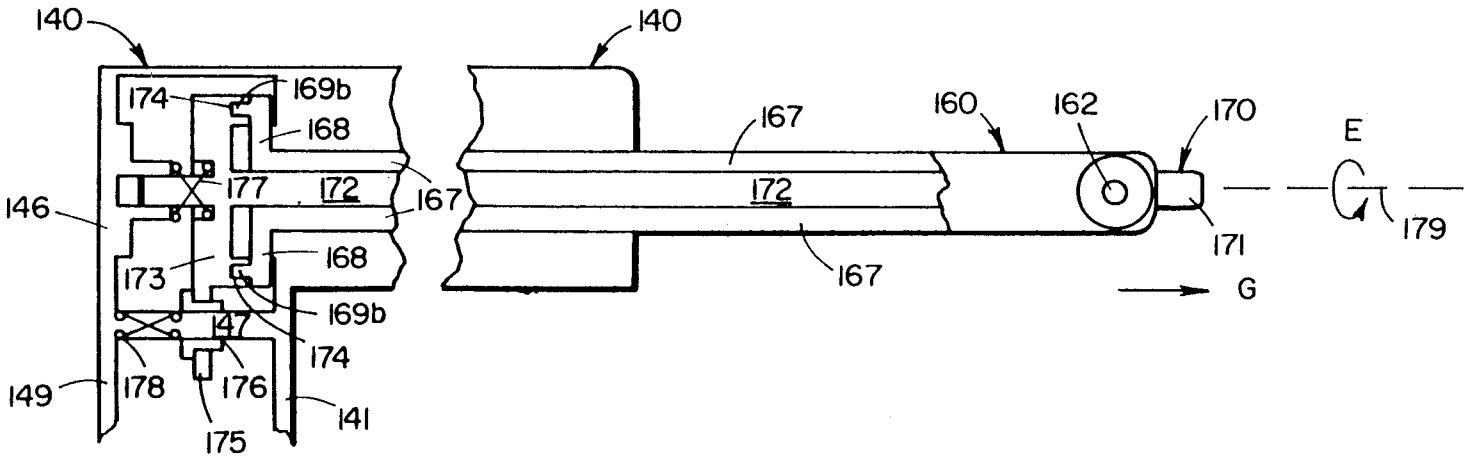
FIG. 18 is a partial cross sectional view of an arm of the automatic force generating and control system of FIG. 1 wherein the handle/arm clutch assembly has reengaged to the handle in the now rotated position.

FIG. 18 shows the assembly 170 positioned to firmly engage the handle 160 with respect to the arm 140 in the new desired position by the operator. The button 171 has been released and accordingly the assembly 170 has been moved in the direction G shown in FIG. 15 by the springs 177 and 178. The pins 169B now firmly engage the pin holes 174 and the handle 160 is firmly positioned with respect to the arm 140 in a similar manner as that described in FIG. 15. The arm 130 and handle 150 have the same clutch assembly activated by button 111, to position the handle 150 at increments of 15 degrees around the handle 140.

Figure 19:
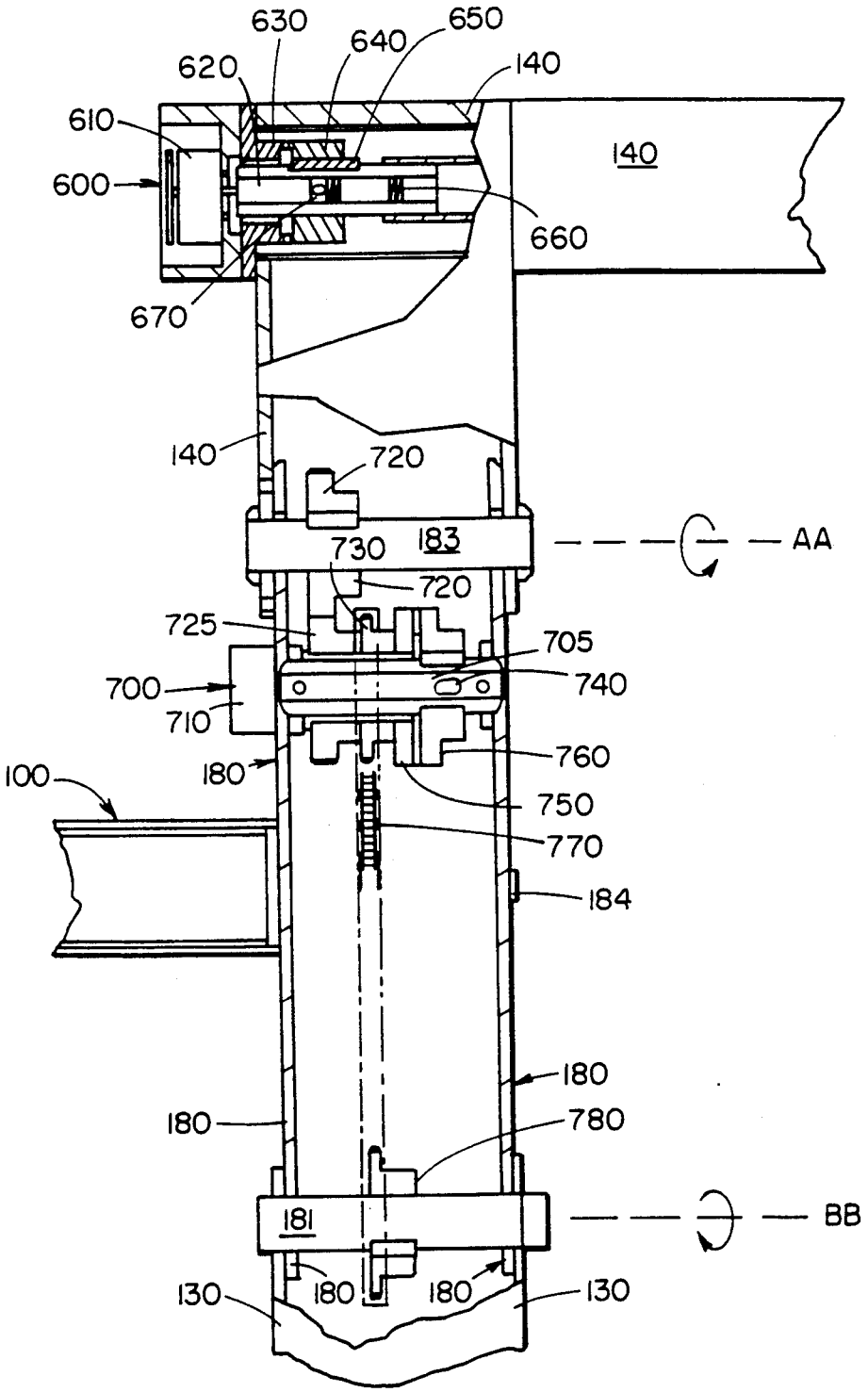
FIG. 19 is a partial cross section of an alternate clutch mechanism for the system of FIG. 1.

FIG. 19 shows a partial cross-section of an alternate embodiment for the handle/arm clutch assembly and the arm/head assembly described above. Specifically, FIG. 19 shows the solenoid handle/arm clutch assembly 600 and the solenoid arm/head clutch assembly 700. The clutch assemblies 600 and 700 are driven by solenoid 610 and 710 which, when activated, release the clutch mechanisms thereby enabling the lever 100 to be reconfigured to the desires of the user. Specifically, the clutch assembly 600 enables the handle 160 to be pivoted with respect to the arm 140. In addition, the clutch assembly 700 enables the arm 140 to be pivoted with respect to the head 180.

The clutch assembly 600 comprises a solenoid (of the push type) 610, a plunger 620, a female clutch 630, a male clutch 640, a key 650, a return spring 660, an activation pin 670, and an activation pin slot 680.

The operation of the clutch assembly 600 is shown in FIGS. 20 and 21 which shows the clutch 60 locked and the solenoid 610 off in one position (FIG. 20), and the clutch 600 unlocked and the solenoid 610 on or energized (FIG. 21). The shaft 612 of the solenoid 610 touches the plunger 620. The plunger 620 resides within the hollow center of the handle shaft 167. When the solenoid 610 is energized as shown in FIG. 21, the shaft 612 strikes the plunger 620 and moves it to the right. This movement of the plunger 620 to the right forces the activation pin 670 also to the right. The pin 670 extends through slots 680 on either side of the hollow center of the handle shaft 167. The slots 680 exist diametrically opposed on either side of the hollow center of the handle shaft 167. The pin 670 further extends past the slots 680 and into radial pin holes 642 of the male clutch 640 (see FIG. 22). The slots 680 arc several times longer than the diameter of holes 647. The handle shaft 167 resides in the hollow center 648 of the male clutch 640 as shown in FIGS. 20 to 22. Thus, when the pin 670 is moved to the right by the plunger 620, the pin 670 strikes the radial slots 642 of the male clutch 640 and moves through the slots 680 thereby moving the male clutch 640 also to the right as shown in FIG. 21. This disengages the ridged teeth 644 of the male clutch 640 from the ridged teeth 634 of the female clutch 630 (FIG. 23). Note that the female clutch 630 also houses the handle shaft 167 in its hollow center 638 as shown in FIGS. 20, 21 and 23. Each of the clutches 630 and 640 have 24 separate teeth which enable the clutches to be rotated at discrete increments of 15 degrees to one another. Other numbers of teeth may be used for different machines and different applications. When the clutch 640 is disengaged from the clutch 630, the clutch 640 is free to rotate around the axis of the arm 140. Thus, when the user rotates the handle 160, the handle shaft 167 also rotates (see FIGS. 15 to 18). When the handle shaft 167 is rotated, the pin 670 forces the male clutch 640 to also be rotated. When the handle 160 attains the position desired by the operator, the solenoid 610 is turned off and the spring 660 forces the pin 670 to the left as shown in FIG. 20. Thus, the clutch 640 is moved to the left and the teeth 644 of the clutch 640 engage the teeth 634 of the female clutch 630.

The key 650 is affixed the handle shaft 167. The key 650 is square in cross section and resides within the slot 646 of the male clutch member 640. The key 650 ensures that the male clutch 640 moves exclusively in an axial movement when moved by the plunger 620 and pin 670.

When the handle 160 achieves the desired position, the user disconnects the solenoid 610 by releasing the button 171 and the spring 680 moves the pin 670 to the left as shown in FIG. 20. At this point, the male clutch 640 engages the female clutch 630 and the teeth 644 firmly engage the teeth 634. Thus, the male clutch 640 may not be rotated with regard to the female clutch 630. Further, the handle shaft 167 may not be rotated with regard to the male clutch 640 because such rotation is prohibited by the key 650 which resides within the slot 646 and the pin 670 which resides within the slot 680 and 642. Thus, the handle 167 is firmly positioned with regard to the male clutch 640. The female clutch 630 is firmly affixed to the arm 140 and the handle shaft 167 is firmly affixed to the handle 160. Thus, when the solenoid 610 is turned off, the handle 160 is firmly positioned with regard to the arm 140 and may not be further rotated.

In this manner, the handle 160 is firmly positioned with regard to the arm 140 until the solenoid 610 is activated, at which time the clutch 640 is moved out of engagement with the clutch 630 and the handle 160 may be rotated or pivoted with respect to the arm 140. Once the desired position of the handle 160 is attained, the user may disengage the solenoid by releasing the button 171 and the male clutch 640 is moved into engagement with the female clutch 630. At this point, the handle 160 is firmly positioned with respect to the arm 140. In this embodiment the clutch is operated electronically as compared to the earlier embodiment wherein the clutch was physically disconnected by the user. An identical clutch is housed within the arm 130 and is electronically connected to button 171 in the alternate embodiment.

The plunger 620 may also be moved against the force of the spring 660 by hydraulic pressure. In that embodiment, a hydraulic line is connected to a push clamp with a shaft positioned against the plunger 620. When pressure flows through the hydraulic line, the shaft is activated by the push clamp and the plunger 620 would be moved, thereby decoupling the clutches 630 and 640. When pressure no longer flows through the hydraulic line, the spring 660 would reengage the clutches 630 and 640.

The operation of the clutch assembly 700 is also shown in FIG. 19. The operation of the solenoid 710 in the clutch 700 is very similar to that of the operation of the solenoid 610 in the clutch assembly 600. Specifically, when the solenoid 710 is energized or engaged by the operation of the clutch release button 184, the male clutch 760 moves to the right as shown in FIG. 19, and is disengaged from the female clutch 750. Thus, the female clutch 750 may be rotated around the shaft 705 of the clutch assembly 700.

At this point, when the clutch 750 is disengaged from the clutch 760, the user may pivot the arm 140 with respect to the head 180. This pivoting is done around shaft 183. Gear 720 is firmly affixed to shaft 183, and therefore, when shaft 183 is rotated, the gear 720 is rotated as well. The gear 720 meshes with gear 725 which is firmly affixed to the female clutch 750. Thus, when the arm 140 is pivoted in a direction such as a counterclockwise AA as shown in FIG. 19, the gear 720 is also rotated in the direction AA. Because gear 725 is clockwise direction BB as shown in FIG. 19. Because gear 725 is firmly affixed to the female clutch 750 and the sprocket 730, both the clutch 750 and 730 rotate around the shaft 705 in the direction BB as well. The sprocket chain or belt 770 meshes tautly with the sprocket 730. The chain 770 also is in taunt mesh with the sprocket 780. Thus, when the sprocket 730 rotates, sprocket 780 rotates in the same direction BB. The sprocket 780 is firmly affixed to rotating shaft 181 and therefore, shaft 181 also rotates in the direction BB. Finally, arm 130 is firmly affixed to the shaft 181 so arm 130 also rotates in the direction BB.

Thus, when the user engages the solenoid 710, the clutch assembly 700 is disengaged and, by pivoting either arm 140 or 130, the opposite arm is pivoted through the same arc and in the opposite direction. Therefore, the arms 130 and 140 always maintain a mirror image relationship.

When the user has pivoted the arms 130 and 140 to the desired position with regard to the head 180, the clutch release button 184 is disengaged and the solenoid 710 is turned off. The return spring moves the pin 740 to the left as shown in FIG. 19 and the male clutch 760 is reengaged with the female clutch 750. When the clutch 750 is reengaged to the clutch 760, neither clutch may rotate with regard to the other. The clutch 760 is prohibited from rotation around the shaft 705 by the pin 740 and the key. Thus, when the clutch 760 is engaged to the clutch 750, the clutch 750 may not rotate around the shaft 705 and accordingly, the sprocket 730 and gear 725 may not rotate either. This also locks the gear 720 and shaft 183 to their position which holds the arm 140 in position with regard to the head 180. Further, the sprocket chain 770 is locked in position which also locks the sprocket 780 and the shaft 181 in position and therefore, the arm 130 may not rotate with regard to the head 180.

The plunger may also be moved against the force of the spring by hydraulic pressure in assembly 700. In that embodiment, a hydraulic line is connected to a push clamp with a shaft positioned against the plunger. When pressure flows through the hydraulic line, the shaft is activated by the push clamp and the plunger would be moved, thereby decoupling the clutches 730 and 740 when pressure no longer flows through the hydraulic line, the spring 730 would reengage the clutches 730 and 740.

FIG. 24 is a partial cross section of the handle 160 showing an alternate embodiment for the buttons 162 and 171. Specifically, as shown in FIG. 24 the buttons 162 and 171 are recessed within the handle 160. The button 162 is electronically connected to the electronic controls 11 and is used to set the start point for exercise. The button 171 is electronically connected to the clutch assembly 700. The handle 150 has buttons 152 and 111. The button 152 is connected to the electronic controls 11 and is used to set the start position of the lever 100 and the button 111 is connected to the solenoid clutch assembly in the arm 130.

Figure 25:
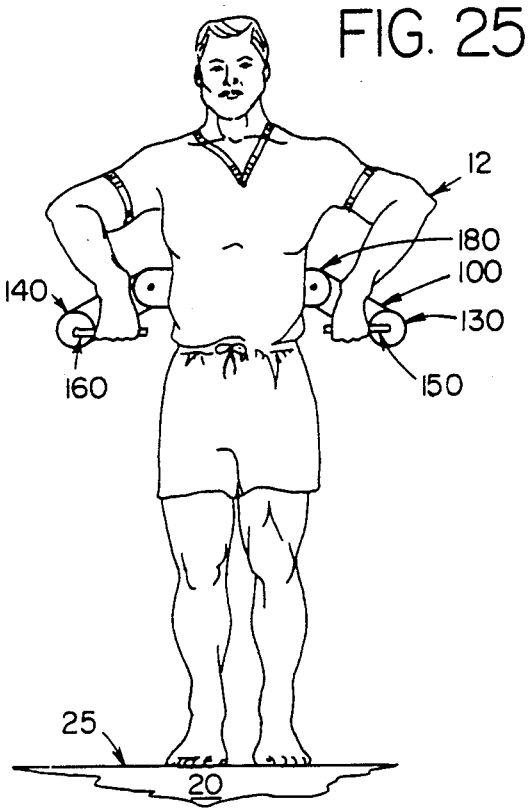
FIG. 25 is a front view of the arm of the system of FIG. 1 in use.
Figure 26:
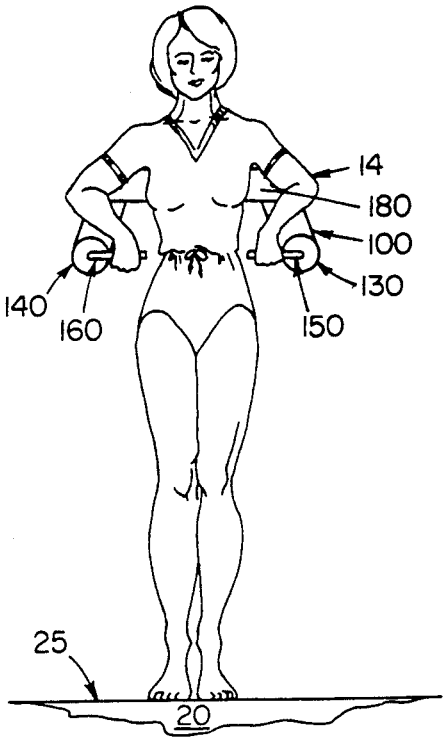
FIG. 26 is another front view of the arm of the system of FIG. 1 in use.

FIGS. 25 and 26 show the lever 100 in use with two different operators, a man 12 and a woman 14 to perform the same exercise. The versatility of the lever 100 to be configured to the particular physiques of different individuals and the exercise to be performed is demonstrated in FIGS. 25 and 26. Because the man 12 has a wider physique than the woman 14, he desires the handles 150 and 160 to be wider apart than the woman 14. This is accomplished by the man 12 pivoting the arms 130 and 140 to a more horizontal position with respect to the head 180, as compared to the woman 14 who has pivoted the arms 130 and 140 to a more perpendicular relationship to the head 180 Specifically, in FIG. 25 the man 12 has pivoted the arms 130 and 140 to an angle 30 degrees below horizontal while in FIG. 26 the woman 14 has pivoted the arms 130 and 140 to an angle 75 degrees below horizontal. Note that in both circumstances, the man 12 and woman 14 have pivoted the handles 150 and 160 with respect to the arms 130 and 140 so that the handles 150 and 160 remain horizontal to the ground.

As shown in FIGS. 25 and 26, because the woman 14 has longer legs than the man 12, she desires the handles 150 and 160 to be higher off the ground (i.e., at her waist) than the man 12 whose waist is lower to the ground. This is accomplished by pivoting the lever 100 higher in its stroke for the beginning point of the exercise. Specifically, the woman 14 has pivoted the lever 100 higher in its pivot stroke to accomplish the exercise than the man 12. Thus, FIG. 15D demonstrates the versatility of the lever 100 to be configured to the particular physique of users to achieve the optimum and most comfortable start positions for the particular exercises. This versatility is accomplished through pivoting the arms 130 and 140 with respect to the head 180, pivoting the handles 150 and 160 with respect to the arms 130 and 140, and positioning the lever 100 within its pivot stroke.

Because the man 12 has longer arms he may desire a longer total stroke than the woman 12. Thus, the man 12 may pivot the lever 100 more (i.e., larger stroke of arc) than the woman 12. Thus, FIGS. 25 and 26 demonstrate the ability of the lever 100 to accommodate different user's physiques for different exercise strokes.

Figure 27:
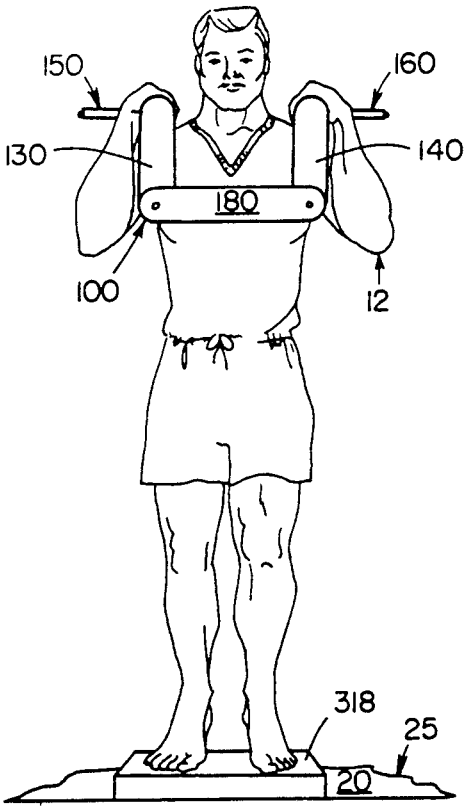
FIG. 27 is a back view of the arm of the system of FIG. 1 in use.
Figure 28:
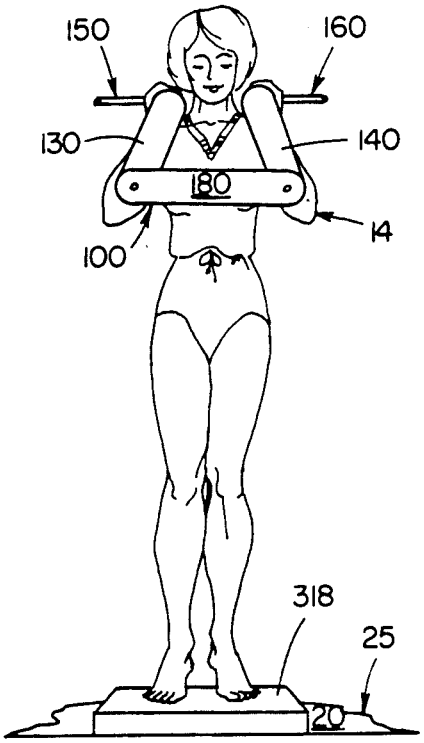
FIG. 28 is another back view of the arm of the system of FIG. 1 in use.

FIGS. 27 and 28 further demonstrate the versatility of the lever 100 to be configured to the particular physique of different users for the same exercise. In FIGS. 27 and 28, the man 12 and the woman 14 are performing toe lifts wherein the exerciser stands with his toes on the toe block 318 and his ankles hanging over the edge of the toe block 318. From this position, the exerciser attempts to stand on his "tip toes" against resistance from the machine upon the shoulders of the exerciser. Thus, FIGS. 27 and 28 show the woman 14 and the man 12 at the top stroke of the exercise. Because the woman 14 has narrower shoulders than the man 12, she desires the arms 130 and 140 to be closer together, and she has accomplished this by pivoting the arms 130 and 140 15 degrees past horizontal. The man 12, because he has broader shoulders, desires the arms 130 and 140 to be further apart, and he has accomplished this by positioning the arms 130 and 140 to a perpendicular relationship to the head 180. Because the shoulders of the woman 14 are closer to the ground than the shoulders of the man 12, she desires the head 180 to be lower than the man 12. The woman 14 accomplishes this by starting the lever 100 lower in its pivot stroke than the man 12. Note that both the woman 14 and the man 12 have pivoted the handles 150 and 160 with respect to the arms 130 and 140 to a horizontal position. Thus, the woman 14 and the man 12 may also wish to grip the handles during this exercise. Thus, FIGS. 27 and 28 demonstrate the versatility of the lever 100 to be configured to the particular physique of individual users for a particular exercise. The versatility of lever 100 to be configured to the particular physique of the particular user is accomplished by pivoting the arms 130 and 140 with respect to the head 180, pivoting the handles 150 and 160 with respect to the arms 130 and 140, and starting the lever 100 at a particular point in its pivot stroke so that each of these positions is optimum and most comfortable for the user.

Figure 30:
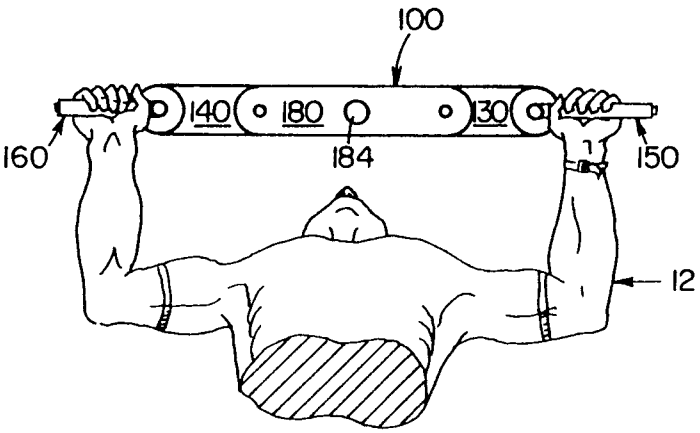
FIG. 30 is another front view of the arm of the system of FIG. 1 in use.
Figure 29:
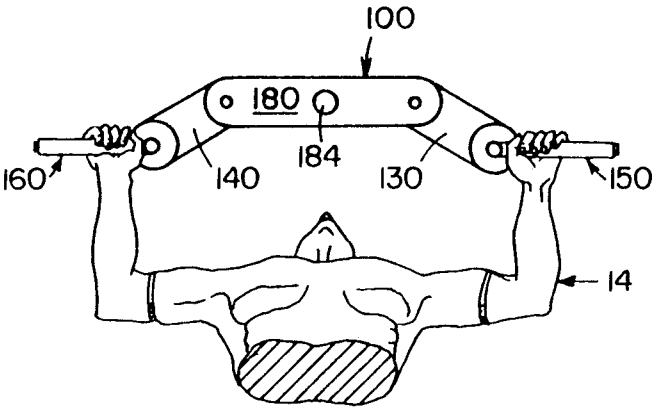
FIG. 29 is a front view of the arm of the system of FIG. 1 in use.

FIGS. 29 and 30 demonstrate the versatility of the lever 100 to be configured for the particular physiques of individual users to perform the same exercise. In FIGS. 29 and 30, the man 12 and woman 14 are performing bench presses. Because the man 12 has broader shoulders, he desires the handles 150 and 160 to be further apart. This is accomplished by pivoting the arms 130 and 140 to the horizontal position with regard to the head 180. In addition, the handles 150 and 160 are pivoted to be horizontal with respect to the ground. Because the woman 14 has narrower shoulders than the man 12, she desires the handles 150 and 160 to be closer together. This is accomplished by pivoting the arms 130 and 140 to an angle below horizontal with respect to the head 180. Specifically, in FIG. 29, the woman has pivoted the arms 130 and 140 to approximately 30 degrees below the horizontal. She has also pivoted the handles 150 and 160 to a horizontal relationship with regard to the ground. Both the man 12 and the woman 14 may position the lever 100 at the start point in its pivot stroke which is most comfortable to themselves. In FIGS. 29 and 30, the position of the lever 100 within its pivot stroke is about the same for both the man 12 and the woman 14.

FIGS. 31 to 42 show the lever 100 configured for various exercises. As discussed above, the versatility of the lever makes it capable of being adapted to various peoples' physiques. Accordingly, these drawings show suggested formations for various exercises, but the individual may wish to alter these so as to achieve the configuration most comfortable and optimum for their particular physique. In addition to the exercises discussed in FIGS. 31 to 42, one ordinarily skilled in the art could configure the machine to perform a great number of exercise. The following list includes some of the exercises capable of being performed upon this machine:

| | |
|---|---|
| Abdominal Crunch | One Arm Bentover Row |
| Abduction | One Arm Curl |
| Adduction | One Arm Shoulder Press |
| Arm Curl | Overhead Tricep Press |
| Back Extension | Rear Leg Lifts |
| Bench Press | Reverse Wrist Curl |
| Bench Pulldown | Seated Dip |
| Bentover Row | Seated Lat Pull |
| Chin-up | Seated Shoulder Press |
| Dip | Shoulder Shrug |
| Heel Raise | Side Bend |
| Incline Press | Single Leg Extension |
| Incline Pulldown | Squat |
| Incline Row | Standing Leg Curl |
| Leg Curl | Standing Row |
| Leg Extension | Supine Pulldown |
| Leg Press | Toe Press |
| Leg Raise | Tricep Pressdown |
| Lunge | Underhand Pulldown |
| Modified Dead Lift | Upright Row |
| Duo Hip | Wrist Curl |
| | Horizonal Abdominal Crunch |

Figure 31:
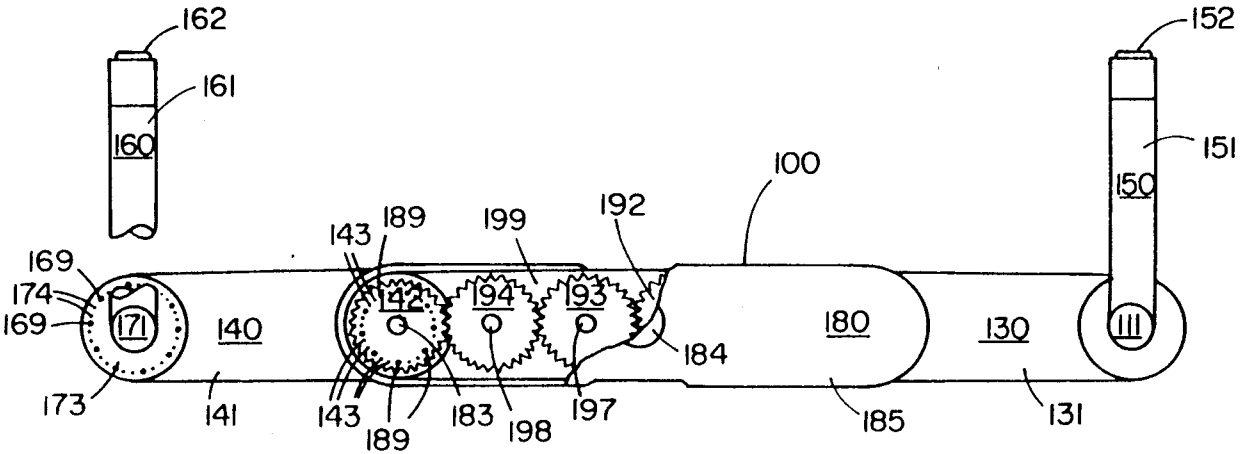
FIG. 31 is a partial cross sectional view of the head, arms, and handles of the automatic force generating and control system of FIG. 1 configured to perform an exercise.

FIG. 31 is a partial cutaway view of the head 180, arms 130 and 140, and handles 150 and 160 configured to perform an exercise. The clutch face 142 is shown along section line XXXI—XXXI shown in FIG. 11. Thus, for the 24 pin holes along the circumference of the face 142, each third hole is occupied by a pin 189 shown as a darkened hole. The clutch face 173 is shown along section line XXXIA—XXXIA shown in FIG. 15. Thus, for the 24 pin holes 174 along the circumference of the face 173, eight are occupied by pins 169 which are shown as a darkened pin hole 174. Therefore, each third pin hole 174 is darkened and occupied by a pin 169.

Figure 36:
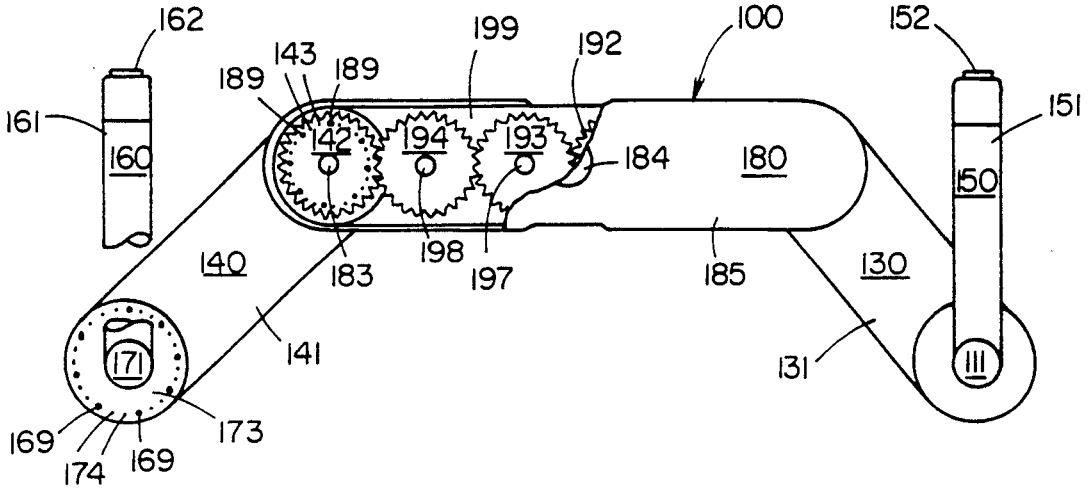
FIG. 36 is a partial cross sectional front view of the head, arms, and handles of the automatic force generating and control system of FIG. 1 configured to perform another exercise, such as a hip flexor.

FIG. 31 shows one configuration for the lever 100 to do a particular exercise such as a hip flexor wherein the arms 130 and 140 have been pivoted to their horizontal (widest) position and the handles 150 and 160 are positioned vertically upwards. For smaller people, the positioning may be achieved as shown in FIG. 36. This demonstrates the versatility of the lever 100 to accommodate a variety of individuals of different sizes.

Figure 32:
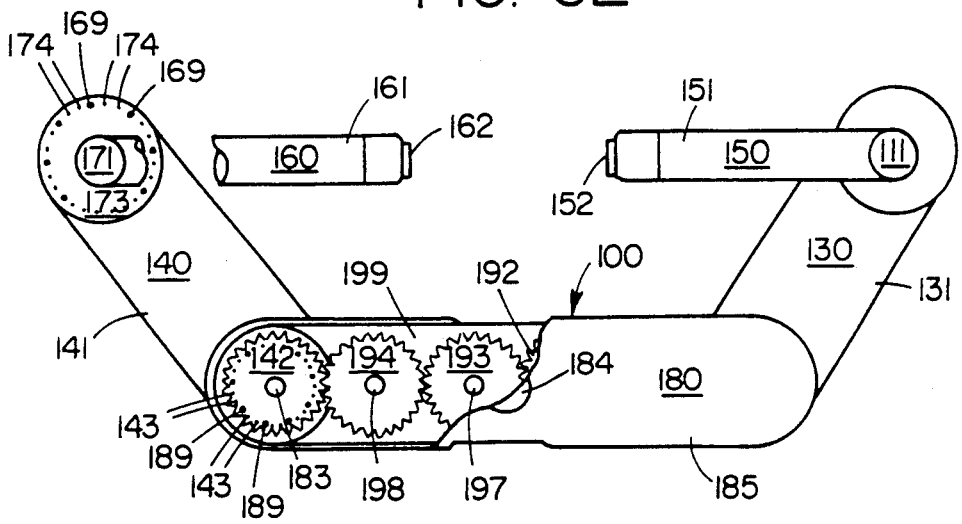
FIG. 32 is a partial cross sectional front view of the head, arms, and handles of the automatic force generating and control system of FIG. 1 configured to perform another exercise, such as a chin-up.

FIG. 32 shows the lever 100 configured to perform another exercise, such as a chin-up. Here the arms 130 and 140 have been positioned 60 degrees above the horizontal and the handles 150 and 160 are positioned horizontal to the ground.

Figure 33:
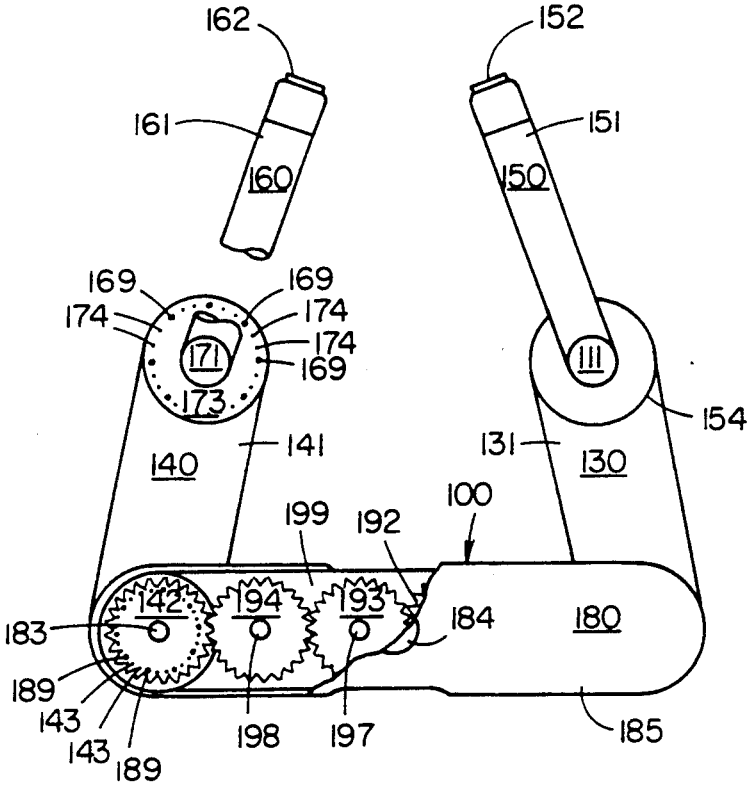
FIG. 33 is a partial cross sectional front view of the head, arms, and handles of the automatic force generating and control system of FIG. 1 configured to perform another exercise, such as a squat.

FIG. 33 shows the lever 100 configured to perform another exercise such as a squat or heel raise. Here the arms 130 and 140 are positioned at 15 degrees above horizontal to accommodate the shoulders of smaller individuals. The shoulders of the user are positioned against the rounded, padded surface 154 and the rounded, padded surface 156 of the arms 130 and 140, respectively.

Figure 34:
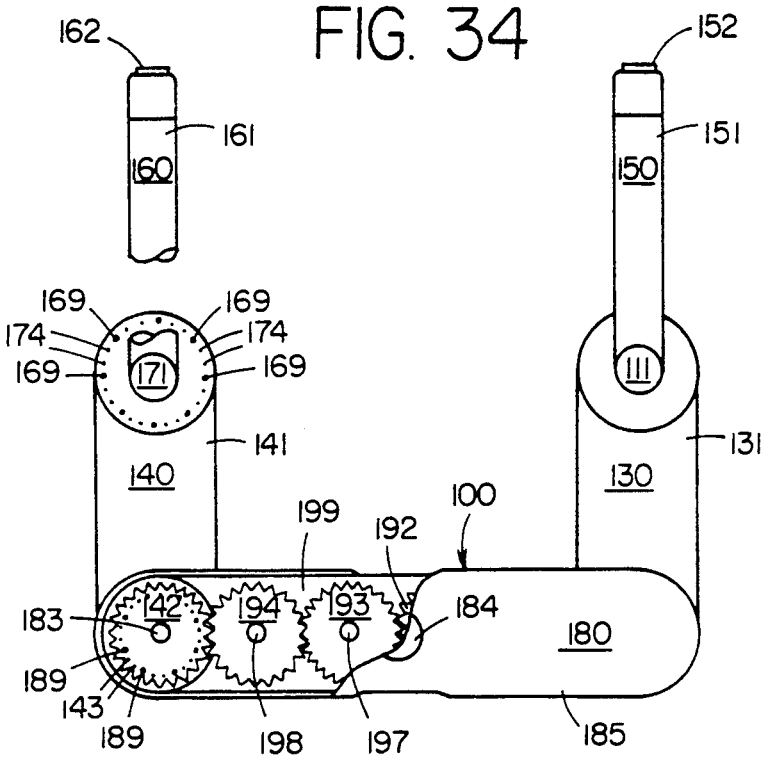
FIG. 34 is a partial cross sectional front view of the head, arms, and handles of the automatic force generating and control system of FIG. 1 configured to perform another exercise, such as a heel raise.

FIG. 34 shows the lever 100 configured to perform other exercises, such as squats, heel raises, leg presses and toe presses. The arms 130 and 140 are positioned vertically as are the handles 150 and 160. In this position individuals may place their shoulder against the surfaces 154 and 156 to perform squat and heel raises. Note that these individuals may be wider than the individuals using the configuration in FIG. 33 for squat and heel raises. Again, this demonstrates the versatility of the lever 100 to accommodate a variety of sizes of individuals to perform the same exercise. The operator may also position his heels against the flat surfaces 138 and 148 to perform leg presses and his toes against the flat surfaces 138 and 148 to perform toe presses.

To perform the leg press and toe press the operator pivots the inner bench portion 320 around the joint 340 and positions the stand 350 in a notch on the monolith 30. Thus, the bench inner portion 320 may be inclined or horizontal with respect to the ground. The operator lies on his back with his lower body portion facing the monolith 30. The operator places his foot for leg presses or toes for toe presses against the flat surfaces 138 and 148. The operators then attempts to move the lever 100 against resistance provided by the arm hydraulics 400.

Figure 44:
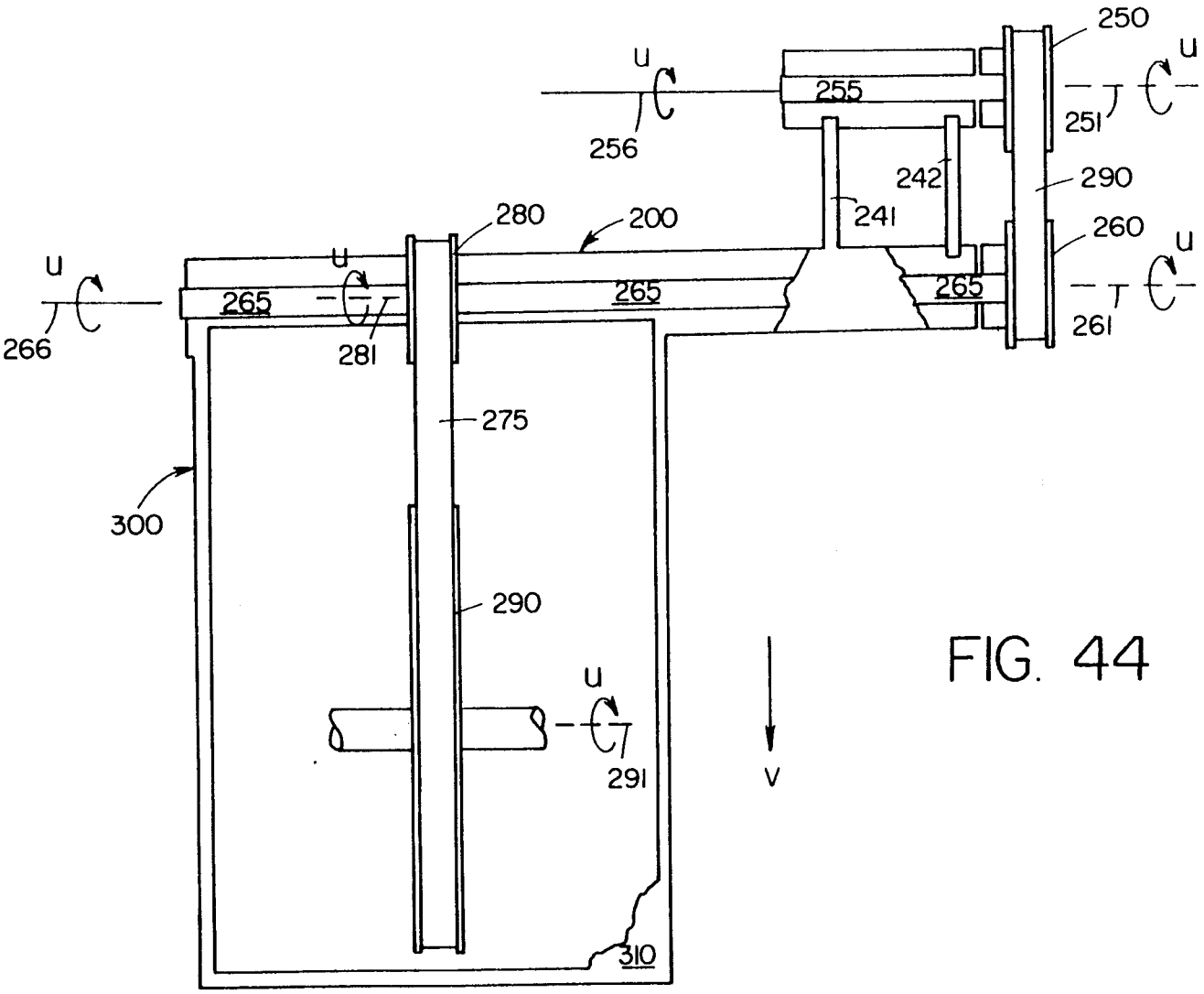
FIG. 44 is a partial cross sectional view of portions of the lower body exerciser of the automatic force generating and control system of FIG. 1.

To perform a squat and heel raise in the configuration shown in FIG. 34 the operator pivots the bench portion 320 away from the monolith as shown in FIG. 44 and stands on the toe block 318 (see FIG. 47) with his shoulders firmly positioned against the rounded surfaces 154 and 156. The operator then attempts to move the lever 100 against resistance provided by the arm hydraulics 400.

Figure 35:
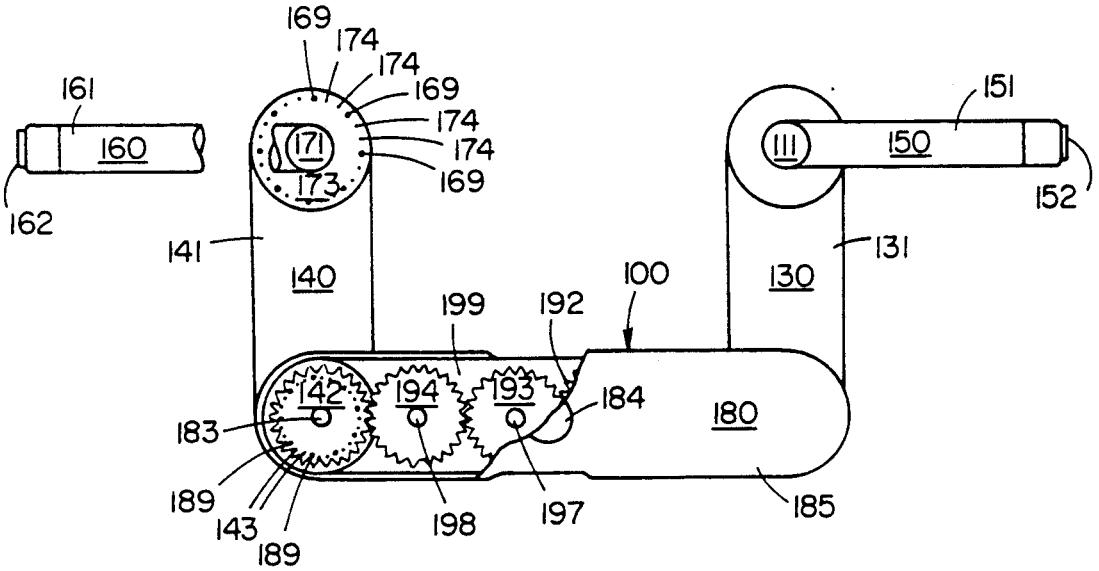
FIG. 35 is a partial cross sectional front view of the head, arms, and handles of the automatic force generating and control system of FIG. 1 configured to perform another exercise, such as a chin-up.

FIG. 35 shows the lever 100 configured to perform other exercises such as a chin-up. The arms 130 and 140 are positioned vertical to the ground and the handles 150 and 160 are positioned horizontal to the ground.

FIG. 36 shows the lever 100 configured to perform another exercise such as a hip flexor. The arms 130 and 140 are positioned 45 degrees below the horizontal and the handles 150 and 160 are positioned vertically. Note that the configuration of the lever 100 accommodates individuals that are not as wide as those using the configuration shown in FIG. 31 to perform hip flexors and demonstrates the versatility of the lever 100 to accommodate a variety of sizes of operators for the same exercise.

Figure 37:
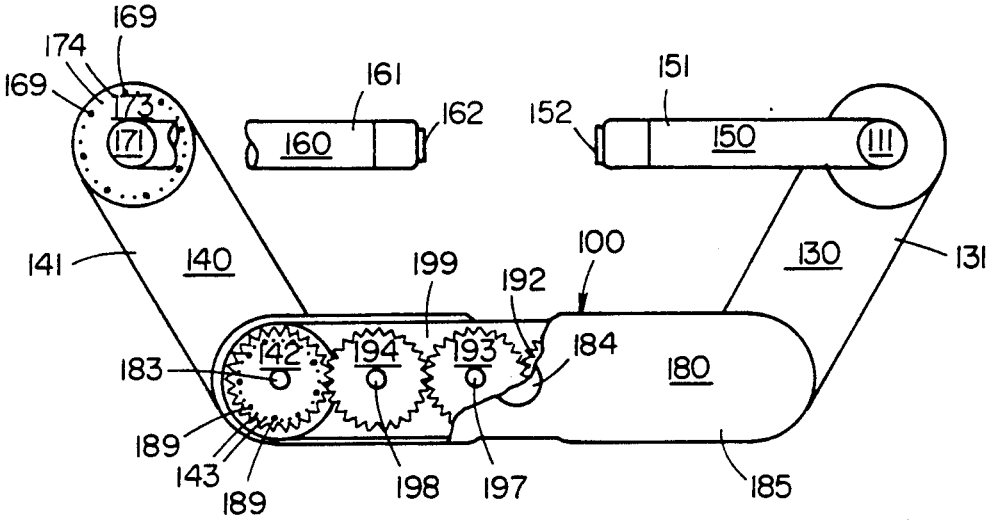
FIG. 37 is a partial cross sectional front view of the head, arms, and handles of the automatic force generating and control system of FIG. 1 configured to perform another exercise, such as a lat pulldown.

FIG. 37 shows the lever 100 configured to perform another exercise, such as a lat pulldown. The arms 130 and 140 are positioned 60 degrees above the horizontal and the handles 150 and 160 are positioned horizontal to the ground and inside the arms 130 and 140. In this exercise the bench portion 320 is pivoted fully out of the way away from the monolith 30 as shown in FIG. 44 and the operator stands inside the arms 130 and 140 and attempts to move the lever 100 against resistance provided by the arm hydraulics 400.

Figure 38:
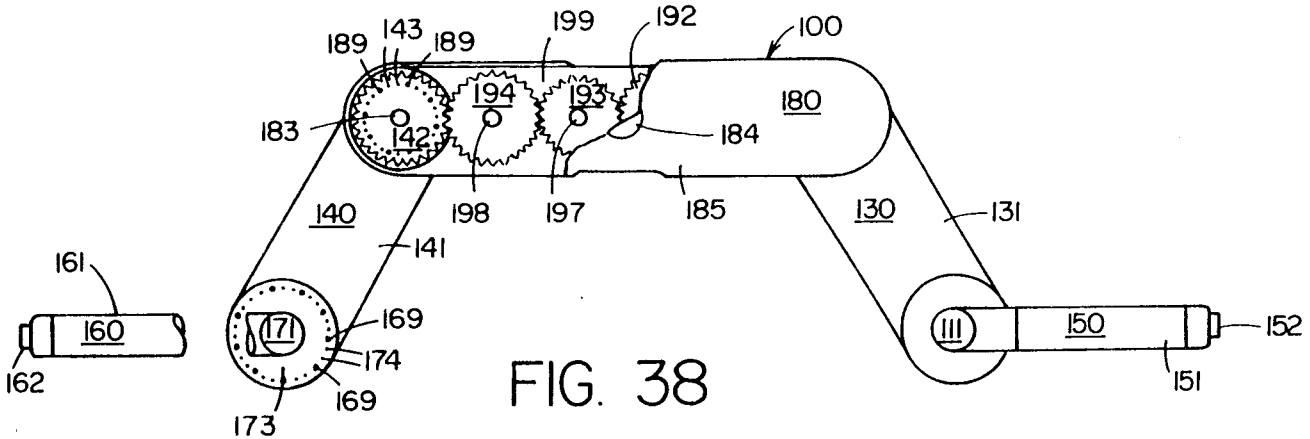
FIG. 38 is a partial cross sectional front view of the head, arms, and handles of the automatic force generating and control system of FIG. 1 configured to perform another exercise, such as a one-arm bent row.

FIG. 38 shows the lever 100 configured to perform another exercise, such as a one-arm bent row, a modified dead lift or an incline lat pulldown. The lever 100 is configured with the arms 130 and 140 sixty degrees below the horizontal and the handles 160 and 150 positioned horizontal to the ground and outside the arms 130 and 140.

Figure 39:
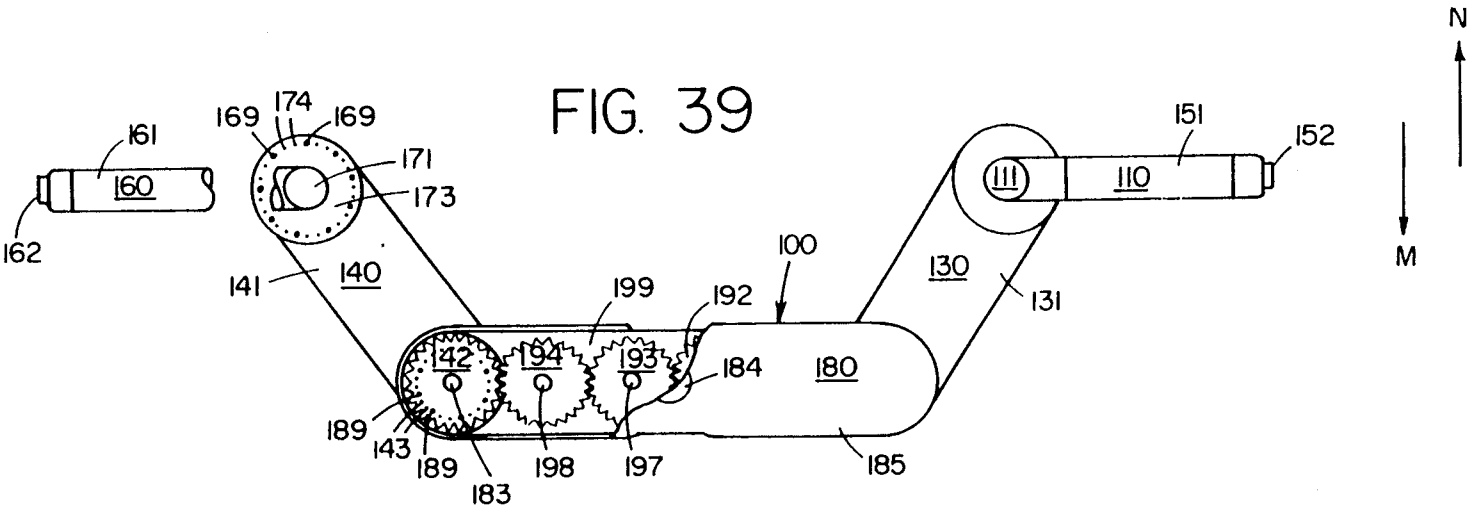
FIG. 39 is a partial cross sectional front view of the head, arms, and handles of the automatic force generating and control system of FIG. 1 configured to perform another exercise, such as a seated shoulder press.

FIG. 39 shows the lever 100 configured to perform another exercise such as a lat pulldown or a seated shoulder press. The arms 130 and 140 are positioned 60 degrees above the horizontal and the handles 150 and 160 are positioned horizontally outside the arms 130 and 140. To perform a lat pulldown the inner bench 320 is moved away from the monolith 30 as shown in FIG. 44 and the operator stands inside the arms 130 and 140. The operators attempts to move the lever 100 in the direction M as shown in FIG. 39 against resistance provided by the arm hydraulics 400. To perform a seated shoulder press the inner bench portion 320 is positioned horizontal to the ground and the stand 350 is positioned within the notch 31 of the monolith 30. The operator sits on the inner bench portion 320 with his back facing the monolith 30 and attempts to move the lever 100 in the direction N shown in FIG. 39 against resistance provided by the arm hydraulics 400. Again, FIG. 39 demonstrates the ability of the arm hydraulics 400 to provide resistance in either direction of movement of the lever 100 depending upon the exercise selected by the operator.

Figure 40:
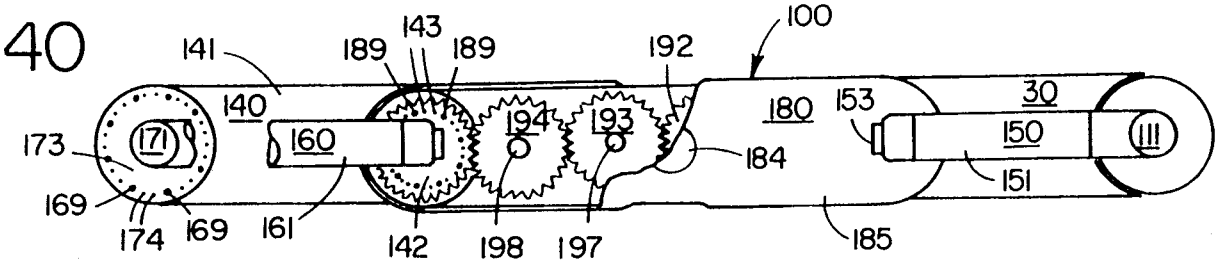
FIG. 40 is a partial cross sectional front view of the head, arms, and handles of the automatic force generating and control system of FIG. 1 configured to perform another exercise, such as a shrug.

FIG. 40 shows the lever 100 positioned to perform a number of exercises including a bench press, a shrug, a triceps press down, a arm flexor, a arm extensor, a supine pulldown, an upright row, a tricep extension and a chin-up. The arms 130 and 140 are positioned horizontal to the ground and the handles 150 and 160 are positioned horizontal to the ground inside the arms. To perform a bench press the inner bench portion is positioned horizontal to the ground and the operator attempts to move the lever 100 against the resistance provided by the arm hydraulics 400. To perform a shrug the inner bench portion 320 is moved away from the monolith 30 and the operator attempts to move the lever 100 against the resistance provided by the arm hydraulics 400. To perform a triceps pressdown the operator attempts to move the lever 100 against the resistance provided by the arm hydraulics 400. To perform a arm flexor the operator stands within the arms 130 and 140 and attempts to move the lever 100 against the resistance provided by the arm hydraulics 400. To perform a arm extensor the operator stands within the arms 130 and 140 and attempts to move the lever 100 against the resistance provided by the arm hydraulics 400. To perform a supine pulldown the inner bench portion 320 is positioned horizontal to the ground and the operator lies upon his back facing upward and attempts to pull the lever 100 against the resistance provided by the arm hydraulics 400. To perform an upright row the operator attempts to move the lever 100 against the resistance provided by the arm hydraulics 400. To perform a triceps extension the inner bench portion 320 is positioned horizontal to the ground and the operator attempts to move the lever 100 against the resistance provided by the arm hydraulics 400. To perform a chin up the inner bench portion 320 is positioned away from the monolith 30 and the lever 100 does not move during this exercise.

Figure 41:
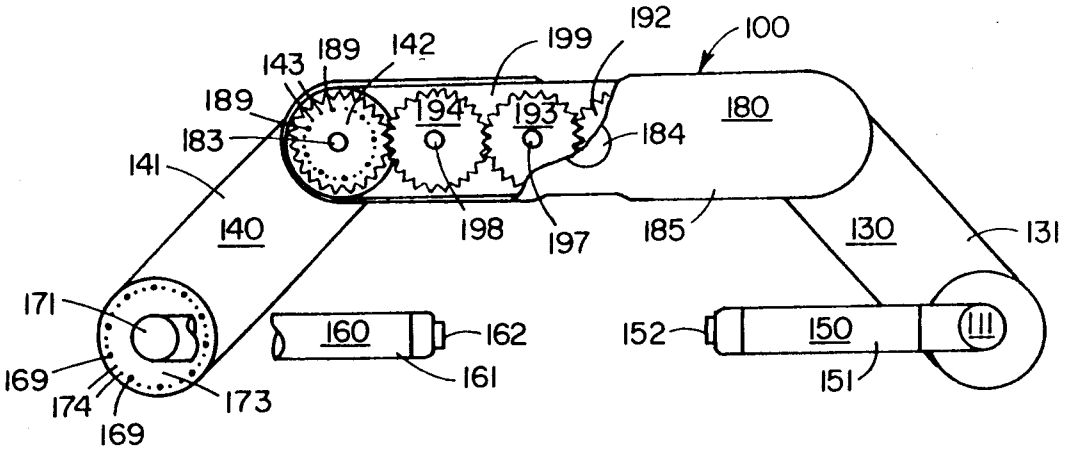
FIG. 41 is a partial cross sectional front view of the head, arms, and handles of the automatic force generating and control system of FIG. 1 configured to perform another exercise, such as a triceps pressdown.

FIG. 41 shows the lever 100 configured to perform other exercises including a triceps pressdown, a biceps curl, an incline press, and a triceps extension. The arms 130 and 140 are positioned 45 degrees the horizontal and the handles 150 and 160 are positioned horizontally inside the arms. To perform a triceps pressdown the inner bench portion 320 is moved away from the monolith 30 and the operator attempts to move the lever 100 against resistance provided by the arm hydraulics 400. To perform a biceps curl the lever 100 and the bench 300 are positioned the same as for the triceps pressdown and the operator attempts to move the lever 100 against resistance provided by the arm hydraulics 400. To perform an incline press the inner bench portion 320 is pivoted above the horizontal and the stand 350 is positioned in one the upper notches 32, 33, 34 or 35 depending upon operator size and preference. The operator sits with his back on the inner bench portion 320 and his head facing away from the monolith 30. The operator attempts to move the lever 100 against resistance provided by the arm hydraulics 400. To perform a triceps extension the inner bench portion 320 is positioned horizontal to the ground and the operator lies on the inner bench portion 320 facing upwards with his head towards the monolith 30. The operator attempts to move the lever 100 against resistance provided by the arm hydraulics 400.

Figure 42:
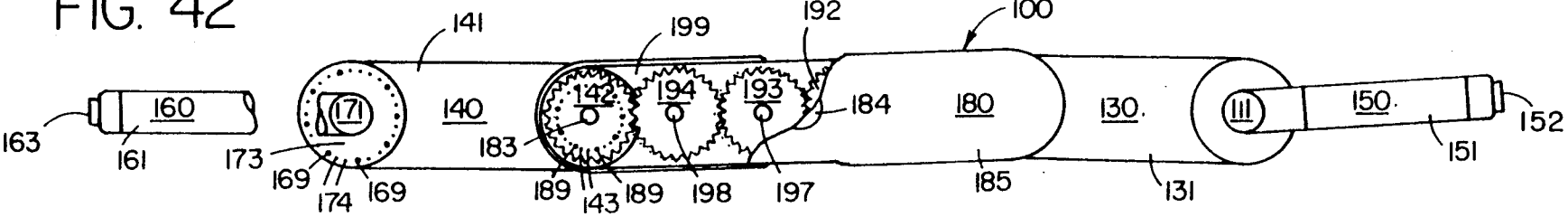
FIG. 42 is a partial cross sectional front view of the head, arms, and handles of the automatic force generating and control system of FIG. 1 configured to perform another exercise, such as a bench press.

FIG. 42 shows the lever 100 configured to perform other exercises including a lat pulldown, a seated shoulder press, a bench press, a toe press, a supine pulldown, an incline lat pulldown and a dip. The arms 130 and 140 are positioned horizontally and the handles 150 and 160 are also positioned horizontally outside the arms 130 and 140. To perform a lat pulldown the inner bench 320 is positioned away from the monolith 30 and the operator stands within the arms 130 and 140. The operator attempts to move the lever 100 against resistance provided by the arm hydraulics 400. To perform a seated shoulder press, the inner bench portion 320 is positioned horizontally and the operator sits on the inner bench portion 320 with his back facing the monolith 30. The operator attempts to move the lever 100 against resistance provided by the arm hydraulics 400. To perform a bench press the same configuration is used except the operator lies with his back on the inner bench portion 320 and faces upwards. A toe press may be performed in the same configuration where the operator lies upon his back with his lower body portion facing the monolith and attempts to move the head 180 with his toes. To perform a supine pulldown the same configuration is used with the operator lying on his back with his head facing the monolith 30 and the operator attempts to move the lever 100 against resistance provided by the arm hydraulics 400. To perform an incline lat pulldown the inner bench portion 320 is adjusted at an incline by positioning the stand 350 in one of the upper notches 32, 33, 34 or 35 (depending upon the size and preference of the operator) and the operator sits upon the bench 300 with his back against the inner bench portion 320 and his head facing away from the monolith 30 and attempts to move the lever 100 against resistance provided by the arm hydraulics 400. To perform a dip the inner bench portion 320 is moved away from the monolith 30.

Figure 43:
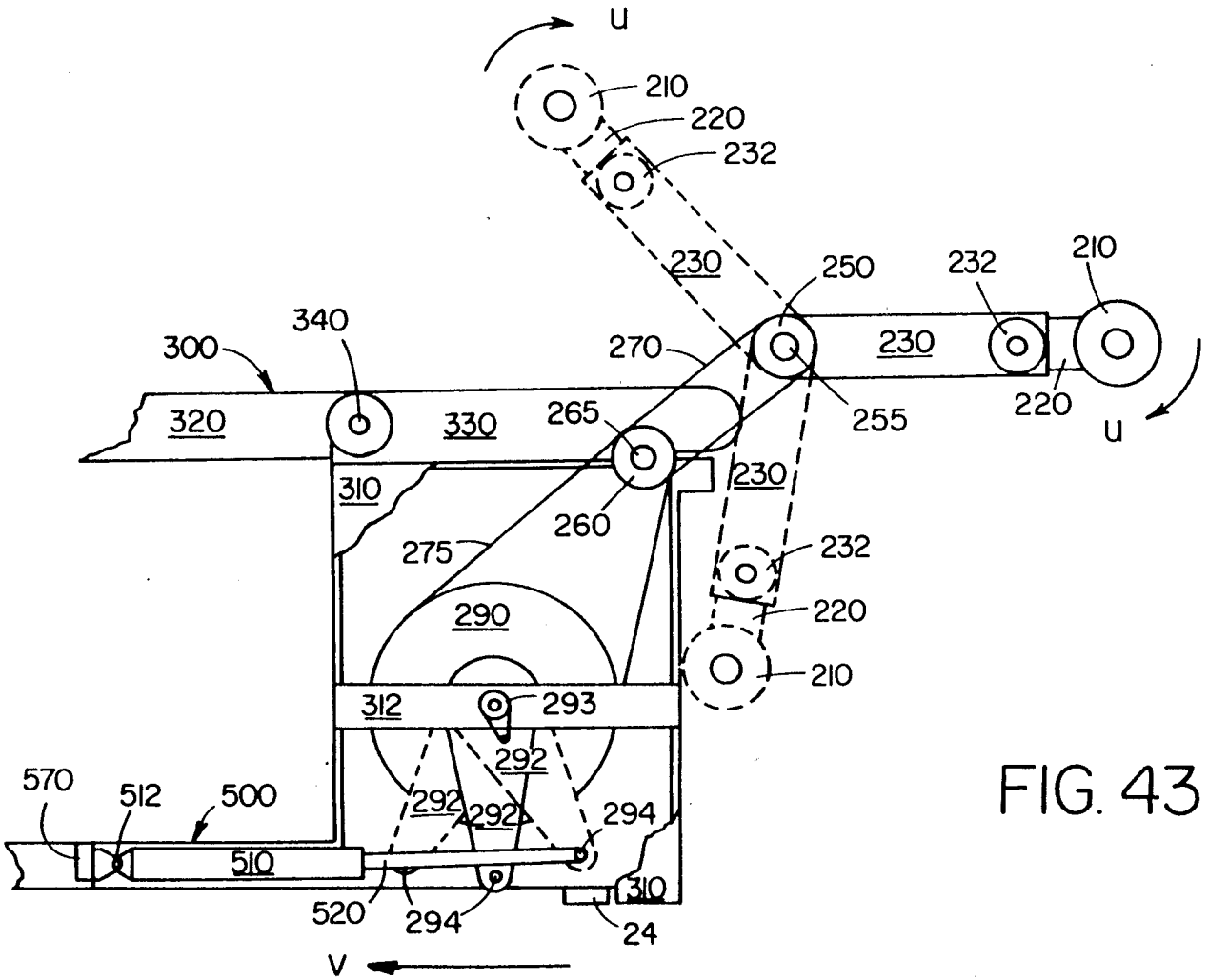
FIG. 43 is a partial cross sectional view of the bench, base, and lower body exerciser of the automatic force generating and control system of FIG. 1.

FIG. 43 is a partial cross sectional view of the bench 300 and the leg hydraulics 500. When the lower body exerciser bar 210 is pivoted in the direction U shown in FIG. 43 the first rotating shaft 255 is rotated and rotates the first sprocket 250. This in turn rotates the first timing chain or belt 270 which rotates the second sprocket 260 and the second rotating shaft 265. In this fashion rotation of the exerciser bar around the first rotating shaft 255 is transmitted to the second rotating shaft 265. The rotation of the second rotating shaft is transmitted to the third sprocket 280 (see FIG. 44). The second timing chain or belt 275 transmits the rotation of the third sprocket 280 to the fourth sprocket 290. The circumference of the first sprocket 250, the second sprocket 260, and the third sprocket 280 are all equal. However, the circumference of the fourth sprocket 290 is four times that of the sprockets 250, 260, and 280. Therefore, each degree of rotation of the shaft 255 equates to one-quarter of a degree of rotation of the fourth sprocket 290. The total stroke of 240 degrees of rotation possible by the exercise bar 210 around the first rotating shaft 255 as shown in FIG. 43 is from the beginning of its stroke wherein it is above and to the left of the first sprocket 250 as shown in FIG. 43 and the end of its stroke which is below and to the left of the first sprocket 250 as shown in FIG. 43. Due to the scaling of sprockets 250, 260, 280 and 290, this equals approximately 60 degrees of stroke for the fourth sprocket 290 and the crank arm 292 attached to the fourth sprocket 290. The stroke of the crank arm 292 equates therefore to approximately 8 inches of stroke of the rod 520 of the leg hydraulics 500. In this manner, the rotation of the exercise bar 210 around the first rotating shaft 255 is transmitted to an essentially linear stroke of the rod 520 of the leg hydraulics 500. Specifically, rotation of the exercise bar 210 in the direction U shown in FIG. 43 results in essentially linear movement of the rod 520 in the direction V shown in FIG. 43. Rotation of the exercise bar 210 in the opposite direction would result in the rod 520 moving in the lateral opposite direction. By regulating the resistance of the rod 520 to enter or leave the cylinder 510 of the leg hydraulics 500 the operator is able to select the resistance of the bar 210 to rotate around the rotating shaft 255.

The leg hydraulics cylinder 510 is pivotally connected to the load cell 570 by the clevis 512. Thus, the cylinder 510 is able to accommodate the slight angle of rotation resulting from the crank arm 292 moving through its entire stroke.

FIG. 44 is a partial cross sectional view of the lower body exerciser 200 and the bench 300 showing the means by which rotation of the first rotating shaft 255 is transmitted to the fourth sprocket 290. The seat 33 and sprocket housing 240 have been removed FIG. 44 for clarity. Specifically, rotation of the first rotating shaft 255 along its axis 256 in the direction U shown in FIG. 44 is transmitted to the first sprocket 250. The first sprocket 250 then rotates around its axis of rotation 251 in the direction U and rotates the first timing chain 270 which rotates the second sprocket 260 around its axis of rotation 261 also in the direction U. The second sprocket 260 is connected to the second rotating shaft 265 which rotates around its axis 266 in the direction U. This rotation is transmitted to the third sprocket 280 which rotates around its axis of rotation 281 in the direction U, as well. The third sprocket 280 rotates the second timing chain 275 which rotates the fourth sprocket 290 around its axis of rotation 291 also in the direction U. This results in the crank arm 292 (see FIG. 43) moving in the direction V shown in FIG. 44. Rotation of the first rotating shaft 255 in the direction opposite U would result in movement of the crank arm 292 in the direction opposite V. Internal braces 241 and 242 of the sprocket housing 240 are dimensioned to keep the sprockets 250 and 260 aligned and at a constant distance.

FIG. 45 demonstrates the versatility of the system 10 to accommodate individuals of different physiques to perform a number of different exercises. In FIG. 45, the arms 130 and 140 have been pivoted 45 degrees above the horizontal with respect to the head 180 and the inner bench portion 320 has been pivoted around joint 340 to the third notch 33. The handles 150 and 160 have been pivoted 15 degrees below the horizontal to accommodate the particular user's desire. The lever 100 has also been positioned within its stroke to the desired starting point. Thus, the handles are precisely where the user desires them and the incline of the bench also meets the user's requirements.

Note, also, that the seat 330 has been pivoted around joint 340 five degrees above the horizontal. This accommodates the user's desire to exercise his lower body with the seat slightly raised.

The seat is slightly raised by use of seat contact blocks 335 (see FIG. 46). These blocks are rotated into position by turning the adjustment 334 which is connected to the rod 336 which extends through opposite sides of the seat base 310. The lower body exerciser 200 has been removed from the base 310 in FIG. 46 for clarity. The blocks 335 correspond to the block contact pads 332 on the underside of the seat 330. The seat 330 may be pivoted to five degrees above horizontal as shown in FIG. 45 or fifteen degrees above horizontal as shown in FIG. 47. In additional, the seat 330 can be set in a horizontal position as shown in FIG. 1. The angle of the seat 330 is determined by which side of contact blocks 335 are positioned against the pads 332, if any. Specifically, if sides 338 of contact blocks 335 are positioned against the pads 332 (as shown in FIG. 46) then the seat 330 will be positioned horizontal. If the ends 339 of the block 335 are positioned within the grooves 337 then the seat 330 will be fifteen degrees above horizontal. For five degrees of angle of the seat 330 the rod 336 is rotated so that side 337 contacts the pads 332.

In FIG. 45 the lower body exerciser 200 has also been positioned as desired by the user. The bar 210 has been pivoted upwards to approximately 60 degrees above horizontal, and the outer leg extension bar 220 has been substantially retracted within the inner leg extension bar 230.

FIG. 47 shows the system 10 reconfigured to perform other exercises. The toe block 318 has been removed from the seat base 310 and positioned beneath the lever 100 to enable the user to stand on the toe block 318 and exercise against the lever 100, as described below with regard to FIG. 27 and 28. In this configuration, the user may position his shoulders against the pads 130 and 140. The user has pivoted the inner bench portion 320 around joint 340 and away from the monolith 30 to provide a space to perform exercises against the lever 100 in a standing position. Note that the user has also pivoted the seat 330 to a position of 15 degrees above horizontal around access 340. Thus, the user has increased the angle as compared to FIG. 45. The user has also pivoted the exercise bar 210 to an angle approximately 30 degrees below the horizontal. In addition, the outer extension bar 220 has been extended out of the inner bench portion bar 230 to the length desired by the user.

FIG. 48 is a partial cut-away view showing the means by which the stand 350 is firmly positioned within the notch 31. Specifically, peg 356 which extends from either side of the stand 350 are positioned within the first sloping slot 31A. Once the peg 356 has been moved through the slot 31A it contacts the horizontal wall 31B and is moved downward and into the second slanting slot 31C and is moved towards the front outer surface 37. The end wall of the second slanting slot 31C is rounded to match the contours of the circular peg 356. In this position the peg 356 is firmly held. To be removed from the notch 31 the peg 356 must retrace its steps, requiring three separate motions. Accordingly, because three separate motions are required, it is highly unlikely that the peg 356 will be removed during the course of normal exercise and accordingly, the bench stand 350 and the bench 300 will remain in a fixed position with respect to the system 10 during the course of exercise.

FIG. 49 is a schematic view of an alternate embodiment for the system 10. In this alternate embodiment both the lever 100 and the lower body exerciser 200 are run off of one hydraulic system. Specifically, in this embodiment only one of the arm hydraulics 400 or leg hydraulics 500 is required. Mechanical movement is translated from one of those hydraulics to both the lever 100 and the lower body exerciser 200 through a mechanical linkage designated generally as 800 in FIG. 49.

In the schematic in FIG. 49 the movement of the lever 100 and the lower body exerciser 200 is linked so that movement of one results in movement of the other. Thus, if either the lever 100 or the leg 200 is hooked up to an hydraulic unit both could be run off of the same hydraulic unit.

As shown in FIG. 49 when the lever 100 is pivoted around pivot 821 the arm 820 is moved by pivot 822. This in turn moves the pivot 823 which is connected to the other end of the arm 820. The pivoting of the arm 820 results in the pivoting of triangular piece 830 which is pivotally connected to the pivot 824 and the pivot 825. Note that the pivot 824 is affixed to the base 25. The movement of the pivot 825 is translated through the arm 840 to the pivot 826. Pivot 826 is also pivotally attached to triangular piece 835 which is pivotally mounted to the base 25 on pivot 827. Triangular piece 835 is pivotally attached to the arm 850 by the pivot 828. Finally, the arm 850 is pivotally attached to the arm 860 by the pivot 829. Arm 860 is pivotally attached to the pivot 229. Thus, when arm 860 is linked to lower body exerciser 200, movement pivoting the lever 100 around the pivot 821 will result in a corresponding pivot of the lower body exerciser 200 around the pivot 229.

In addition to the elimination of one of the hydraulic units, this embodiment also eliminates a number of components used in the lower body exerciser in the previous embodiment including the first sprocket 250, the second sprocket 260, the second rotating shaft 265, the belt 270, the belt 275, the third sprocket 280, the fourth sprocket 290 and the crank arm 292. In this embodiment the arm hydraulics 400 are used to provide resistance to the system. However, one ordinarily skilled in the art could use the lower body exerciser 200 to provide resistance to the system through the leg hydraulics 500.

FIGS. 50 to 53 demonstrate the operation of the lower body exerciser 200 in this embodiment 800. FIGS. 50 and 51 show the lower body exerciser 200 configured with the linkage 800 to exercise with a stroke of approximately ten degrees past horizontal as shown in FIG. 50 to approximately horizontal as shown in FIG. 51. Specifically, the bar 860 has been attached to the bar 230 by pin 862 so that the bar 860 is firmly affixed to the bar 230 and, when the arm 860 is pivoted around the pivot 229, the bar 230 is similarly rotated. FIGS. 50 and 51 show the two limits to rotation of the arm 860 around the pivot 229 possible in the linkage embodiment 800.

Because some exercises may require the bar 230 to be above horizontal, such as abdominal crunches, the linkage embodiment 800 is constructed to accommodate these configurations. Specifically, as shown in FIGS. 52 and 53, the bar 230 may be pivoted with respect to the arm 860 and firmly affixed by pin 862 as shown in FIG. 52. Thus, the starting point for the bar 230 is approximately forty-five degrees above horizontal in FIG. 52 as compared to ten degrees past vertical as shown in FIG. 50. From this starting point the ninety degrees of stroke capable of being delivered by linkage 800 takes the bar 230 to approximately forty-five degrees past vertical as shown in FIG. 53. Thus, two discrete ninety degree strokes are capable of being delivered by the linkage 800 to the lower body exerciser 200.

Figure 55:
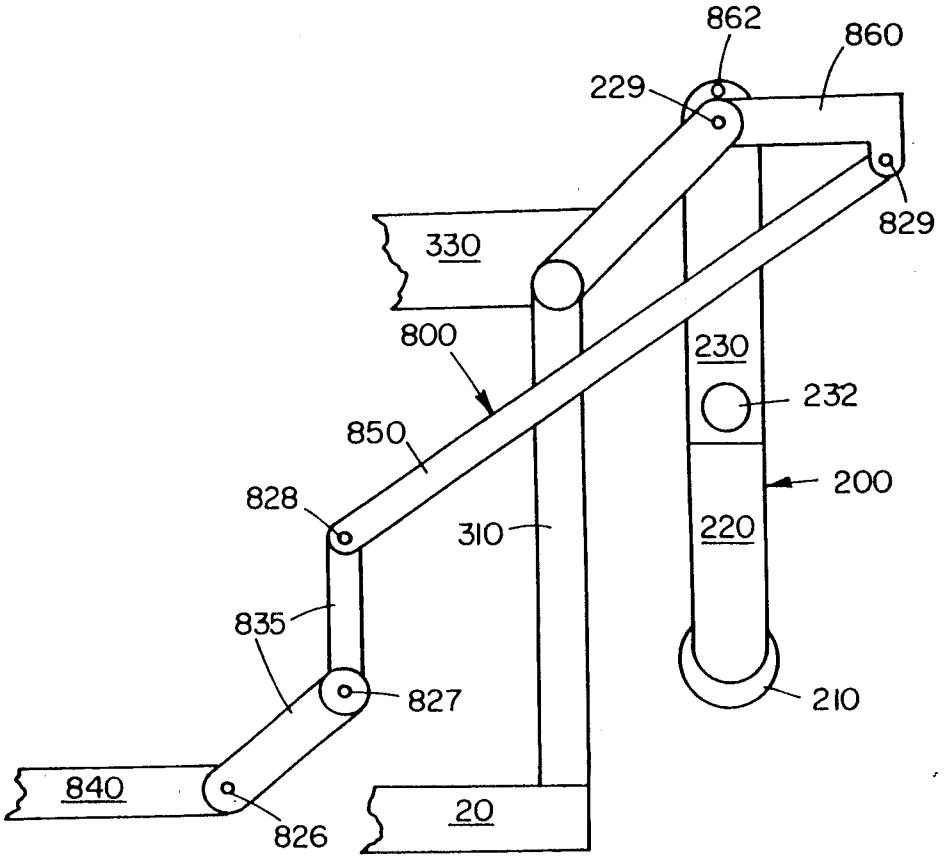
FIG. 55 is another right side view of the lower body exerciser portion of the alternate linkage embodiment of FIG. 49 disconnected to the lower body exerciser.
Figure 54:
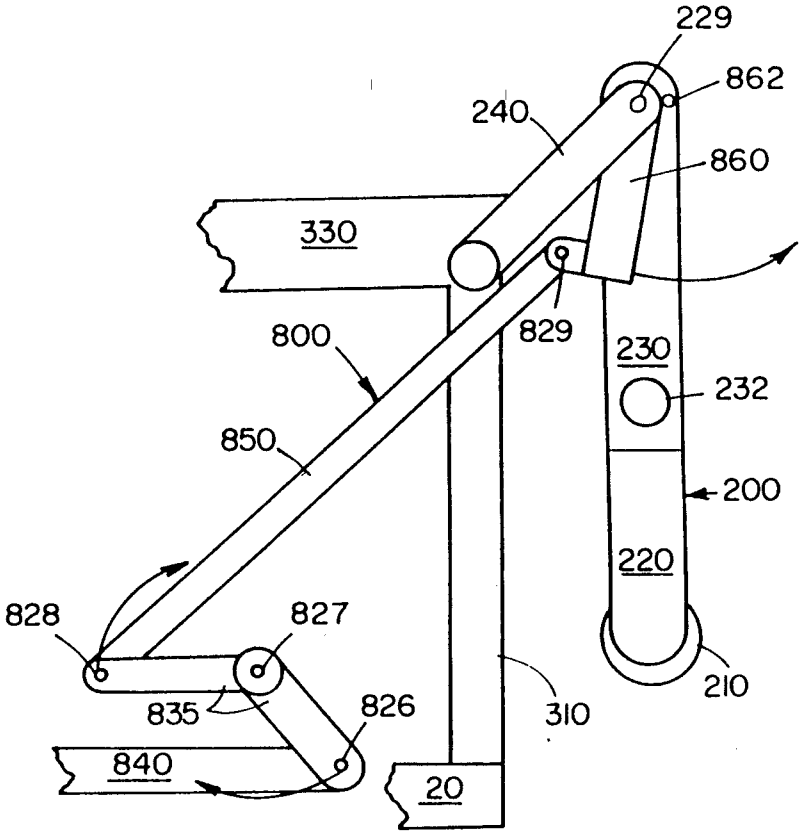
FIG. 54 is a right side view of the lower body exerciser portion of the alternate linkage of FIG. 49 disconnected to the lower body exerciser.

FIGS. 54 and 55 demonstrate that the lower body exerciser 200 may be disconnected from the linkage 800 so that the lower body exerciser bar 200 does not move as the lever 100 is moved. Specifically, as shown in FIG. 54 if the pin 862 is removed then the bar 230 is no longer connected to the arm 860 and, as shown in FIG. 55, when the arm 860 is rotated the lower body exerciser bar 230 is not moved. Thus, the user may move the lever 100 without causing a movement of the lower body exerciser 200.

While the invention has been described in detail with respect to specific embodiments, it will be apparent to one skilled in the art that various changes and modifications can be made without departing from the spirit and scope thereof. For example, the present invention can be used in a number of different applications which take advantage of a number of mechanical features described herein. For example, the device can be used in medical, occupational, or therapy applications. For example, those users that are overcoming specific injuries or disabilities can use the force generation system in accordance with occupational therapist requirements. The work-out related data can be analyzed by the occupational therapist or physician.

Another example is its use in robotics. In other words, the force generation and control system would allow a mechanism such as a robot to perform tasks based upon the amount of sensed pressure. For example, a gripping function can be performed by modulating the control force of the gripping element through the forced generation and control device.

The above description and drawings are only illustrative of preferred embodiments which achieve the objects, features and advantages of the present invention, and it is not intended that the present invention be limited thereto. Any modifications of the present invention which comes within the spirit and scope of the following claims is considered part of the present invention.

What is claimed and desired to be protected by U.S. Letters Patent is:

1. An exercise machine, comprising:

a base adapted to remain essentially stationary during use of the exercise machine;

a lever including a head and at least one arm;

said head having an arm end and a base end, and being pivotally connected at its base end to the base;

said at least one arm having a first end and a second end, and being pivotally connected at its first end to the arm end of the head;

said head and said at least one arm being sized for said at least one arm to be forced by the user of the exercise machine to pivot the lever with respect to the base;

said lever further including first locking means for releasably locking said head and said at least one arm in a selected one of a plurality of fixed positions with respect to one another, so that the user of the exercise machine may initially pivot the head and said at least one arm to positions appropriate for the physique of the user and an exercise to be performed and may then lock the head and said at least one arm with respect to each other to maintain such positions during the exercise; and resistance means for resisting the force of the user of the exercise machine to pivot the lever with respect to the base.

2. A machine as in claim 1 wherein there are a first arm and a second arm and said lever includes rotational transmission means for connecting the first and second arms to the head such that the pivoting in an arcuate direction through an arc of rotation of one of the first and second arms by the user of the exercising machine results in the pivoting of the other of the first and second arms through the same arc of rotation and in an opposite arcuate direction.

3. A machine as in claim 1, wherein said lever includes at least one handle pivotally attached to the second end of one of said at least one arm and said lever further includes second locking means for releasably locking said at least one handle in a fixed position with respect to the respective at least one arm so that the user of the exercise machine may initially pivot said at least one handle with respect to the corresponding at least one arm to positions appropriate for the physique of the user and an exercise to be performed and then lock said at least one handle with respect to the corresponding at least one arm to maintain such positions during the exercise.

4. The exercise machine of claim 3 wherein said second locking means includes:

a clutch assembly including an arm clutch face attached to the arm such that the arm clutch face cannot pivot with respect to the arm, and a handle clutch face which is attached to the handle so that the handle cannot rotate with respect to the handle clutch face and, as the handle clutch face and as the handle rotates with respect to the arm, the handle clutch face rotates with respect to the arm clutch face, and the handle and arm clutch faces being sized and shaped such that when the faces are placed in contact with one another they may not rotate with respect to one another;

disengaging means for moving the arm and handle clutch faces out of contact and away from one another; and engaging means for moving the arm and handle clutch faces into contact.

5. The exercise machine of claim 4 wherein the handle clutch face includes a disk with its center running through the axis of rotation of the handle to the arm and perpendicular to the axis and the disk being firmly attached to the handle by a cylindrical, hollow handle shaft which extends along the axis of rotation and outward of the arm so that as the handle is pivoted around the axis, the shaft, the disk and the handle clutch face also pivot;

and wherein the arm is hollow and the arm clutch face includes a disk with its center running through the axis of rotation and perpendicular to the axis;

said disengaging means including an arm rod which is firmly secured to the arm and inside the hollow center of the arm and extends in a second axis parallel to the axis of rotation of the handle around the arm a guide flange which is secured to the arm clutch face and contains a hole which houses the arm rod so that the arm clutch face is restricted to linear movement along the second axis of rotation and rotation around the arm rod, a clutch rod which is attached to the arm clutch face and extends in one direction through the hollow center of the hollow handle shaft and ends near the surface of the handle and extends in the other direction of the axis past the arm clutch face, and a guide socket which is attached to the inner wall of the hollow center of the arm and houses the clutch rod and restricts movement of the clutch rod except for linear movement along and rotational movement around the axis of rotation of the handle with respect to the arm, the two rods, guide socket and flange thereby restricting any rotation of the arm clutch face with respect to the arm and permitting only linear movement of the arm clutch face along the axis of rotation of the handle and arm and being sized so that when the rod is moved linearly along the axis of rotation of the handle into the arm by the user of the exercise machine, the arm clutch face is moved linearly away from the handle clutch face;

said engaging means including a first spring positioned between the guide socket and the arm clutch face, and a second spring positioned between the guide flange and the inside wall of the hollow center of the arm so that as the arm clutch face and guide flange are moved into the arm and linearly away from the handle clutch face, the springs are deformed and when the user no longer exerts force on the clutch rod to deform the springs, the springs return to their non-deformed position and move the arm clutch face back into engagement with the handle clutch face.

6. The machine of claim 5 wherein the arm clutch face has a plurality of ridged teeth around its circumference and further wherein the handle clutch face has a plurality of ridged teeth around its circumference such that when the two surfaces are moved into contact, the two sets of ridged teeth interlock and mesh.

7. The machine of claims 6 wherein the arm and handle clutch faces each have 24 ridged teeth.

8. The exercise machine of claim 5 wherein the handle clutch face has a plurality of pins equally spaced around its circumference and further wherein the arm clutch face has a plurality of pinholes equally spaced around its circumference, the pinholes being sized to snugly house the pins, such that when the two surfaces are moved into contact, the pins enter the pinholes and the two clutch faces are interlocked.

9. The machine of claim 8 wherein the first clutch face has eight pins and the second clutch face has 24 pinholes.

10. The exercise machine of claim 4 wherein:

the handle clutch face includes a hollow cylinder with a longitudinal key slot in its inside center surface and a radial pin hole running diametrically through the center and extending through both sides of the cylinder, the center of the cylinder running through the axis of rotation of the handle to the arm;

a cylindrical, hollow handle shaft which attaches the cylinder to the handle and which extends along the axis of rotation and outward of the arm with a pin slot running diametrically through the center and extending through both sides of the handle shaft, the pin slot being several times longer in length than the radial pin hole of the clutch face; and a rectangular key firmly attached to the outside surface of the handle shaft and positioned within the longitudinal key slot of the clutch face so that the cylindrical clutch face when positioned with the handle shaft in its hollow center and the key within its key slot may not rotate with respect to the shaft and may only move linearly back and forth along the axis of the shaft;

the arm is hollow and the arm clutch face includes a hollow cylinder firmly attached to the arm with its center running through the axis of rotation;

an activation pin positioned within the handle shaft and extending through both sides of the shaft through the pin slot and further extending through both sides of the cylindrical clutch face through the radial pin holes so that the clutch face may not be rotated with respect to the shaft and when the pin is moved along the axis of rotation, the pin contacts and moves the radial pin holes along the axial length of the pin slots and the clutch face is moved linearly with respect to the handle shaft;

said disengaging means includes a solenoid assembly having a center shaft and positioned within the arm upon the axis of rotation of the handle around the arm so that when the solenoid assembly is energized the shaft extends out of the solenoid along the axis of rotation, a plunger with a solenoid side and a pin side positioned within the hollow center of the handle shaft and in contact on its solenoid side with the solenoid shaft and on its pin side with the activation pin so that when the solenoid shaft is extended, the plunger is moved along the axis of rotation and strikes the activation pin which also moves linearly and thereby contacts the radial pin holes and moves the handle clutch face linearly along the axis of rotation through the pin slot in the shaft and out of engagement with the arm clutch face;

said engaging means includes a spring positioned within the hollow center of the shaft and between the activation pin and the end wall of the hollow shaft so that when the pin is moved linearly by the solenoid assembly through the pin slot in the shaft the spring is deformed between the pin and the end wall and when the solenoid is deenergized the spring moves the pin and thereby the handle clutch face linearly back into engagement with the arm clutch face.

11. The machine of claim 10 wherein the handle clutch face has a plurality of ridged teeth along its circumference and further wherein the arm clutch face has a plurality of ridged teeth along its circumference such that when the two surfaces are moved into contact, the two sets of ridged teeth interlock and mesh.

12. The machine of claims 11 wherein the arm and handle clutch faces each have 24 ridged teeth.

13. The exercise machine of claim 1 wherein said first locking means includes a clutch assembly including two head clutch faces attached to the head by a head clutch plate such that the head clutch faces cannot pivot with respect to the head, said clutch assembly further including an arm clutch face attached to said at least one arm so that said arm cannot rotate with respect to the arm clutch face and, as the arm rotates with respect to the lever, the arm clutch face rotates with respect to the lever clutch face, and the arm and lever clutch faces being sized and shaped such that when the faces are placed in contact with one another they may not rotate with respect to one another;

said first locking means further including disengaging means for moving the lever and arm clutch faces out of contact and away from one another and engaging means for moving the lever and arm clutch faces into contact.

14. The exercise machine of claim 13 wherein:

said head is hollow and the arm clutch face includes a disk with its center running through the axis of rotation of the arm to the lever and perpendicular to the axis;

the lever clutch face includes a disk with its center extending through and perpendicular to the axis of rotation of the disk, the head clutch plate having two ends positioned within the hollow center of the head and having a head clutch face on either end, the head clutch faces each being a disk with a hole extending through the center;

such clutch assembly includes two pivot shafts extending within the hollow of the head one each along the axis of rotation of one of the arms to the head, each pivot shaft extending through a hole in the clutch plate so that the head clutch plate and lever clutch faces may not pivot with respect to the head and may only move linearly along the axes of rotation of the arms to the head, and such clutch assembly further includes two arm clutch faces including two disks each with a hollow center and each being positioned on one of the pivot shafts and firmly attached to one of the arms so that as one of the arms is pivoted with respect to the head, the arm clutch face is pivoted with respect to the head clutch face and the head and arm clutch faces being sized and shaped such that when the faces are placed in contact with one another, they may not rotate with respect to one another;

said disengaging means including a button on the lever clutch plate which may be pushed by the user of the exercise machine thereby moving the lever clutch faces linearly along their pivot shafts away and out of contact with the arm clutch faces; and said engaging means including a first spring and a second spring, each spring being positioned around one of the pivot shafts and between the head clutch face and an inner wall of the hollow head so that when the clutch faces are moved along the pivot shafts the springs are deformed and when the user no longer engages the clutch plate, the springs become non-deformed and thereby move the head clutch faces back into engagement with the arm clutch faces.

15. The machine of claim 14 wherein the head clutch faces each have a plurality of ridged teeth around their circumference and further wherein the arm clutch faces each have a plurality of ridged teeth around their circumferences such that when the two surfaces are moved into contact, the two sets of ridged teeth interlock and mesh.

16. The machine of claims 15 wherein the head and arm clutch faces each have 24 ridged teeth.

17. The exercise machine of claim 14 wherein the head clutch faces each have a plurality of pins equally spaced around their circumference and further wherein the arm clutch face each have a plurality of pinholes equally spaced around their circumference, the pinholes being sized to snugly house the pins, such that when the two surfaces are moved into contact, the pins enter the pinholes and the two clutch faces are interlocked.

18. The machine of claim 17 wherein the head clutch faces each have eight pins and the arm clutch faces each have 24 pinholes.

19. The exercise machine of claim 1 wherein the head is hollow and said first locking means includes:

a clutch assembly including;

a pivot shaft running through the hollow center of the head, parallel to the axes of rotation of the arms around the head;

an arm clutch face comprising a disk with a hole in the center mounted upon the shaft so that the disk may rotate around the shaft;

a sprocket firmly engaged to the disk and also mounted on the shaft so that as the arm clutch face is rotated, the sprocket also rotates;

a gear also firmly engaged to the disk and also mounted on the shaft so that as the arm clutch face rotates, the gear also rotates;

a first arm pivot shaft running along the axis of rotation of the first arm to the head and pivotally connected between the first arm and the head so that the first arm may pivot around the head;

a second gear firmly positioned upon the first arm pivot shaft and of the same size as the first gear and in contact with the first gear so that when the first shaft is rotated, the first arm pivot shaft is also rotated through the same arc and in the opposite direction;

a second arm pivot shaft extending along the axis of rotation of the second arm to the head and pivotally connected between the second arm and the lever so that the second arm may pivot around the head;

a second sprocket firmly positioned upon the second arm pivot shaft and of the same size as the first sprocket and pivotally connected to the first sprocket by a belt so that when the first shaft is rotated, the second arm pivot shaft is also rotated through the same arc and in the same direction;

and wherein the head clutch face comprises a hollow cylinder with a longitudinal key slot in its inside center and radial pin holes running diametrically through its center and extending through both sides of the cylinder, the center of the cylinder being positioned on the pivot shaft and the pivot shaft being hollow with activation pin slots positioned diametrically on opposite walls of the shaft the pin slots being several times longer than the diameter of the pin holes;

a rectangular key firmly attached to the outside surface of the pivot shaft and positioned within the longitudinal key slot of the head clutch face so that the cylindrical clutch face when positioned with the pivot shaft in its hollow center may not rotate with respect to the pivot shaft and may only move linearly back and forth along the axis of the shaft;

an activation pin positioned within the hollow pivot shaft and extending through the pin slots of the pivot shaft and further through the radial pin holes of the lever clutch face so that the clutch face may not be rotated with respect to the pivot shaft and when the pin is moved along the axis of rotation through the pin slots it contacts the radial pin holes and thereby moves the head clutch face linearly with respect to the pivot shaft;

said disengaging means including a solenoid assembly having a center shaft and positioned within the arm upon the axis of rotation of the pivot shaft so that when the solenoid is energized the shaft extends out of the solenoid along the axis of rotation, and a plunger having a solenoid side and a pin side positioned within the hollow center of the pivot shaft and in contact on its solenoid side with the solenoid shaft and on its pin side with the activation pin so that when the solenoid shaft is extended, the plunger is moved along the axis of rotation and strikes the activation pin which also moves linearly and thereby moves the handle clutch face linearly along the axis of the shaft and out of engagement with the arm clutch face; thereby enabling the arm clutch face to be rotated by either the second gear on the first arm pivot shaft or the second sprocket on the second arm pivot shaft;

and wherein the engaging means includes a spring positioned within the hollow center of the shaft and between the activation pin and the end wall of the hollow shaft so that when the pin is moved linearly by the solenoid assembly the spring is deformed between the pin and the end wall and when the solenoid is deenergized the spring moves the pin and thereby the lever clutch face linearly back into engagement with the arm clutch face and prohibiting any further rotation of the arm clutch face or the arms with respect to the head.

20. A machine as in claim 1 wherein the head is hollow low and said rotational transmission means is positioned within the head and includes a first gear attached to the first arm so that the first arm and the first gear pivot together, and a second gear attached to the second gear so that the second gear and second arm pivot together, the first gear and second gear being sized and connected to one another so that when the first gear rotates the second gear rotates in the opposite direction.

21. A machine as in claim 20 wherein the first and second gears are connected through a series of gears positioned between them.

22. The machine of claim 20 wherein said rotational transmission means includes:

a third gear of the same size as the first gear and in pivotal contact with the first gear so that the third gear rotates through the same arc and in the opposite direction as the first gear;

a fourth gear of the same size as the third gear and in pivotal contact with the third gear so that the fourth gear rotates through the same arc and in the same direction as the first gear;

a fifth gear of the same size as the fourth gear and in pivotal contact with the fourth gear so that the fifth gear rotates through the same arc and in the opposite direction as the first gear;

a sixth gear of the same size as the fifth gear and in pivotal contact with both the fifth gear and second gear so that the sixth gear rotates through the same arc and in the same direction as the first gear and thereby rotates the second gear through the same arc and in the opposite direction as the first gear.

23. The machine as in claim 1 wherein the lever is hollow and the rotational transmission means is positioned within the hollow center of the lever and includes:

a first gear firmly attached to the first arm so that the first arm and the first gear pivot together;

a second gear which is of the same size as the first gear and is mounted on a second gear shaft within the hollow center of the lever and in pivotal contact with the first gear so that when the first gear is rotated, the second gear and second gear shaft are rotated in the opposite direction and through the same arc;

a first sprocket mounted on the second gear shaft so that the first sprocket is rotated through the same arc and in the opposite direction of the first gear;

a second sprocket of the same size as the first sprocket and firmly connected to the second arm so that when the second sprocket is rotated, the second arm is rotated; and a chain which tautly engages the first and second sprocket so that when the first sprocket is rotated, the second sprocket is rotated through the same arc and in the same direction.

24. An exercise machine, comprising:

a base which remains stationary with respect to the use of the exercise machine, the base including a substantially flat platform and a bench suitably sized for supporting the user;

an arm having a bench end and an exercise end, the arm being pivotally connected at its bench end to the bench and the arm sized to be forced by the user of the exercise machine to pivot with respect to the bench;

resistance means for resisting the force of the user of the exercise machine to pivot the arm with respect to the bench thereby exercising the user when the user pivots the arm and further wherein the resistance means comprises a hydraulics including a rod, piston and cylinder with the piston connected to the rod and the rod moving within the cylinder, and the hydraulics being positioned substantially within the platform; and force transmission means for transmitting the rotational force of the user, expended by pivoting the arm with respect to the bench, to linear force of the cylinder into and out of the piston.

25. The exercise machine of claim 24 wherein the hydraulics are also positioned below the bench.

26. An exercise machine, comprising:

a base which remains stationary with respect to the user of the exercise machine;

a lever having a base end and an exercise end and pivotally connected at its base end to the base and the lever being sized to be forced by the user of the exercise machine with respect to the base;

resistance means for resisting the force of the user of the exercise machine to pivot the lever with respect to the base thereby exercising the user when the user pivots the lever;

monitoring means for electronically determining the amount and direction of the force being exerted by the user on the lever and the position, speed and direction of movement of the lever with respect to the base so that the electronic determinations may be used as feedback by the exercise machine in setting the resistance;

and wherein the resistance means includes a hydraulics assembly including a cylinder, rod and piston with the piston connected to the rod and the rod moving within the cylinder, the hydraulics assembly having a base end and a lever end and pivotally mounted at the base end to the base and pivotally mounted at the lever end to the lever so that when the lever is pivoted with respect to the base, the piston is moved linearly into and out of the cylinder; and the monitoring means includes a load cell including a cantilever beam with a base end and a hydraulics end which is attached at its base end to the base and at the hydraulics end to the base end of the hydraulics assembly so that when the user exerts a force into or away from the hydraulics assembly, the cantilever is deformed in a certain direction and angle accordingly and the load cell further including a strain gauge mounted on the cantilever so that the direction and amount of deflection may be converted into an electronic signal.

27. The machine of claim 26 wherein the monitoring means further includes a potentiometer mounted between the base and the lever so that when the user moves the lever with respect to the base, the position of the arm with respect to the base and the direction and speed of movement of the arm with respect to the base is converted into an electronic signal.

28. The machine of claim 27 wherein the lever is a crank arm attached to a sprocket which is pivotally attached to the base.

29. An exercise machine, comprising:

a base which remains stationary with respect to the user of the exercise machine;

an arm having a base end and an exercise end, said arm being pivotally connected to the base at its base end and the arm being sized for the arm to be forced by the user of the exercise machine to pivot the arm with respect to the base;

adjusting means for adjusting the length of the arm;

locking means for releasably locking the arm at the length conductive to the physique of the user and the exercise to be performed;

resistance means for resisting the force of the user of the exercise machine to pivot the arm with respect to the base and thereby exercise the user when the user moves the arm;

exercise motion transmission means for transmitting the pivoting motion of the arm to linear motion;

a hydraulic assembly including a cylinder, piston and rod with the piston connected to the rod and the rod moving within the cylinder, the hydraulics assembly having a base end and an arm end connected at its base end to the base;

a first sprocket having an arm end and a hydraulics end which is pivotally connected at its arm end to the arm so that when the arm rotates, the first sprocket rotates and the first sprocket also being pivotally connected to the hydraulics at its hydraulics end so that as the sprocket rotates, the piston is moved linearly with respect to the cylinder;

a crank arm which connects the hydraulics assembly to the first sprocket;

a first rotating shaft which is connected to the arm so that they both rotate together;

a second sprocket which is firmly positioned upon the first rotating shaft so that the first rotating shaft and second sprocket rotate together;

a third sprocket of the same size as the second sprocket and which is pivotally connected to the second sprocket by a first belt so that the second sprocket and third sprocket rotate together;

a second rotating shaft, pivotally connected to the third sprocket so that the second rotating shaft rotates with the third sprocket; and a fourth sprocket mounted upon the second rotating shaft so that as the second shaft is rotated, the fourth sprocket is rotated and the fourth sprocket being pivotally connected by a second belt to the first sprocket so that when the arm is pivoted the first rotating shaft, the second sprocket, the first belt, the third sprocket, the second rotating shaft, the third sprocket, the second belt, the first sprocket and the crank arm are also rotated thereby moving the piston of the hydraulics assembly linearly with respect to the cylinder.

30. An exercise machine, comprising:

a base which remains stationary with respect to the user of the exercise machine;

a first arm having a base end and an exerciser end, pivotally connected at its base end to the base;

a second arm having a base end and an exerciser end and also pivotally connected at one end to the base, the arms being sized for the arms to be formed by the user of the exercise machine to pivot with respect to the base;

rotational transmission means for transmitting the rotation of one arm to the other; and resistance means for resisting the force of the user of the exercise machine to pivot the arms with respect to the base thereby exercising the user when the user moves the arms;

and further wherein the rotational transmission means further includes a series of rigid members and pivots;

and further wherein the rotational transmission means further includes;

a first rigid member having a first end and second end pivotally connected to the first arm at its first end so that as the first arm is pivoted, the pivot is transmitted to the first member;

a first rigid triangular member having a first end, a second end and a corner, pivotally connected to the base at the corner and pivotally connected to the first member at its first end, so that as the first member is pivoted, the first triangular member is pivoted around its corner;

a second rigid member having a first end and a second end being pivotally connected to the second end of the first triangular member at its first end, so that as the first triangular member pivots, the second member is also pivoted;

a second triangular member having a first end, a second end and a corner being pivotally connected to the base at its corner and pivotally connected to the second end of the second member at its first end so that as the second member is pivoted, the second triangular member is pivoted around its corner;

a third rigid member having a first end and second end and being pivotally connected to the second end of the second triangular member at its first end so that as the second triangular member pivots with respect to the base, the third member is also pivoted;

a fourth member having a first end and a second end being pivotally connected at its first end to the second end of the third member so that as the third member pivots, the fourth member also pivots and further wherein the fourth member is pivotally connected to the base at the same pivot point as the second arm and the fourth member being fixed to the second arm so that when the fourth member pivots, the second arm also pivots thereby translating the rotation of one arm with respect to the base to the second arm.

31. The exercise machine of claim 30 wherein the fourth member may be disconnected from the second arm thereby enabling the user to pivot the first arm while the second arm remains stationary.

32. An exercise machine comprising:

a base which remains stationary with respect to the user of the exercise machine;

an arm connected to the base and being sized for the arm to be forced by the user of the exercise machine to move the arm with respect to the base;

resistance means for resisting the force of the user of the exercise machine to move the arm with respect to the base;

the base further including;

an upright structure from which the arm projects, a platform which is substantially flat and is connected to the upright structure and resides below the upright structure;

a bench connected to and above the platform and sized and positioned with respect to the arm and upright structure such that the user may lie on the bench and interact with the arm, the bench further including a seat portion and a back portion, the seat portion having a first side and a second side and the back portions having a first side, second side and underside, the first side of the first seat back portion being pivotally connected to the first side of the back portion;

adjustment means for adjusting the angle between the back portion and the seat and releasably positioning the seat and back at various angles;

and further wherein the adjustment means includes:

a stand having a back end and a notch end, pivotally connected at its back end to the underside of the back portion;

notches disposed at various heights upon the upright member such that as the back portion is pivoted with respect to the seat portion by the user to the angle desired by the user to accommodate the physique of the user and the exercise to be performed, the stand may be pivoted with respect to the back portion and the notch end of the stand may be releasably secured in the notch in the upright member appropriate to the angle desired by the user;

and further wherein the stand further includes:

two pegs each disposed on opposite sides of the notch end of the stand which slide into the notches;

and further wherein the notches each include:

a first slanting slot which extends from the outer surface of the upright member at an angle down and into the upright member;

a vertical wall at the end of the first slanting slot and inside the upright member; and a second slanting slot which is connected to the first slanting slot and the vertical wall and extends at a angle down and towards the outer surface of the upright member and does not extend to the outer surface of the upright member so that each peg, when positioned within the notch, is moved in three separate directions and is thereby well secured in the notch.

33. An exercise machine, comprising:

a base which remains substantially stationary;

an exercise member having a base end and an exercise end, said exercise member being pivotally connected to said base at its base end and said exercise member being sized to be force by said user to pivot with respect to said base;

adjusting means for adjusting the length of said exercise member;

locking means for releasably locking said exercise member at the length conductive to the physique of said user and the exercise to be performed;

resistance means for resisting the force of said user of said exercise machine to pivot said exercise member with respect to said base and thereby exercise said user when said user moves said exercise member;

wherein said resistance means, comprises:

a hydraulic assembly including a cylinder, piston and rod with the piston connected to the rod and the rod moving within the cylinder, the hydraulic assembly having a base end and an exercise member and connected at its base end to the base; and a first sprocket having an exercise member end and a hydraulics end which is pivotally connected at its exercise member and to the exercise member so that when the exercise member rotates, the first sprocket rotates and the first sprocket also being pivotally connected to the hydraulics at its hydraulics end so that as the sprocket rotates, the piston is moved linearly with respect to the cylinder;

positioning means for positioning said exercise member under substantially no resistance to an angle in its pivot conducive to the physique of said user and the exercise to be performed at the start of the exercise;

wherein said positioning means provides force to said exercise member to overcome the weight and friction of said exercise member while it is being positioned;

exercise motion transmission means for transmitting the pivoting motion of said exercise member to linear motion;

a crank arm which connects the hydraulic assembly to the first sprocket;

a first rotating shaft which is connected to the exercise member so that they both rotate together;

a second sprocket which is firmly positioned upon the first rotating shaft so that the first rotating shaft and second sprocket rotate together;

a third sprocket of the same size as the second sprocket and which is pivotally connected to the second sprocket by a first belt so that the second sprocket and third sprocket rotate together;

a second rotating shaft, pivotally connected to the third sprocket, so that the second rotating shaft rotates with the third sprocket; and a fourth sprocket mounted upon the second rotating shaft so that as the second shaft is rotated, the fourth sprocket is rotated and the fourth sprocket being pivotally connected by a second belt to the first sprocket so that when the exercise member is pivoted, the first rotating shaft, the second sprocket, the first belt, the third sprocket, the second rotating shaft, the third sprocket, the second belt, the first sprocket and the crank arm are also rotated thereby moving the piston of the hydraulic assembly linearly with respect to the cylinder.

34. An exercise machine, comprising:

a base which remains substantially stationary;

a first exercise member having a base end and an exercise end, pivotally connected at its base end to said base;

a second exercise member having a base end and an exercise end and also pivotally connected at one end to said base, said exercise members being sized to be forced by a user of said exercise machine to pivot with respect to said base;

each exercise member being connected at different locations to said base so that said user only applies force to one exercise member at any given time;

said first exercise member being capable of performing a first plurality of exercises, said second exercise member being capable of performing a second plurality of exercises, each said second plurality of exercises being non-simultaneous from each said first plurality of exercises;

bidirectional rotational transmission means for transmitting the rotation in either direction of either exercise member to the other, said bidirectional rotational transmission comprising:

a series of rigid members and pivots;

a first rigid member having a first end and second end pivotally connected to the first exercise member at its first end so that as the first exercise member is pivoted, the pivot is transmitted to the first rigid member;

a first rigid triangular member having a first end, a second end and a counter, pivotally connected to the base at the corner and pivotally connected to the first rigid member at its first end, so that as the first rigid member is pivoted, the first rigid triangular member is pivoted around its corner;

a second rigid member having a first end and a second end being pivotally connected to the second end of the first rigid triangular member at its first end, so that as the first rigid triangular member pivots, the second rigid member is also provided;

a second triangular member having a first end, a second end and a corner being pivotally connected to the base at its corner and pivotally connected to the second end of the second rigid member at its first end so that as the second rigid member is pivoted, the second triangular member is pivoted around its corner;

a third rigid member having a first end and a second end and being pivotally connected to the second end of the second triangular member at its first end so that as the second triangular member pivots with respect to the base, the third rigid member is also pivoted;

a fourth member having a first end and a second end being pivotally connected at its first end to the second end of the third rigid member so that as the third rigid member pivots, the fourth member also pivots and further wherein the fourth member is pivotally connected to the base at the same pivot point as the second exercise member and the fourth member being fixed to the second exercise member so that when the fourth member pivots, the second exercise member also pivots thereby translating the rotation of one exercise member with respect to the base to the second exercise member.

resistance means for resisting the force of said user to pivot said exercise members with respect to said base thereby exercising said user when said user moves said exercise members.

35. The exercise machine of claim 34 wherein the fourth member may be disconnected from the second arm thereby enabling the user to pivot the first arm while the second arm remains stationary.

36. An exercise machine comprising:

a base which remains substantially stationary;

an exercise member connected to said base and being located so as to be moved by said user of said exercise machine during exercise;

resistance means for resisting the force of said user of said exercise machine to move said exercise member with respect to said base;

said base further including:

an upright structure from which said exercise member projects;

a platform which is substantially flat and is connected to said upright structure and resides below said upright structure; and a bench connected to and above said platform and sized and positioned with respect to said exercise member and upright structure such that said user may lie on said bench and interact with said exercise member, said bench further including a seat portion and a back portion, said seat portion having a first side and a second side and said back portion having a first side, second side and underside, said first side of said seat portion being pivotally connected to said first side of said back portion;

adjustment means for adjusting the angle between said back portion and said seat portion and releasably positioning said back portion at various angles while said seat portion remains substantially stationary with respect to said base; said adjustment means comprising:

a stand having a back end and a notch end, pivotally connected at said back end to said underside of said back portion; and a plurality of notches disposed at various heights upon said upright structure such that as said back portion is pivoted with respect to said seat portion by said user to the angle desired by said user to accommodate the physique of said user and the exercise to be performed, said stand may be pivoted with respect to said back portion and said notch end of said stand may be releasably secured in said notch in said upright structure appropriate to the angle desired by said user;

said stand further comprising:

two pegs each disposed on opposite sides of said notch end of said stand which slides into said notches;

said notches each comprising:

a first slanting slot which extends from an outer surface of said upright structure at an angle down and into said upright structure;

a vertical wall at the end of said first slanting slot and inside said upright structure; and a second slanting slot which is connected to said first slanting slot and said vertical wall and extends at an angle down and towards said outer surface of said upright structure and does not extend to said outer surface of said upright structure so that each peg, when positioned within said notch, is moved in three separate directions and is thereby well secured in said notch.

37. An exercise machine, comprising:

a base which remains substantially stationary;

an exercise member connected to said base;

an exercise support member connected to said base and positioned in the vicinity of said exercise member so that said user of said exercise machine may be positioned on said exercise support member while exercising;

said exercise support member being movably connected to said base such that said exercise support member may be selectively moved away from the vicinity of said exercise member so that said user of said exercise machine may use said exercise member without being positioned on said exercise support member;

said exercise support member comprising a bench which is pivotally connected to said base so that said bench may be pivoted out of the vicinity of said exercise member;

said bench comprising a seat portion having a first side and a second side and a back portion having a first side and a second side and said first side of said seat portion being pivotally connected to said first side of said back portion so that said back portion may be pivoted away from said exercise member while said seat portion remains substantially stationary with respect to said base; and wherein the movement of the center of gravity of said back portion over and past said pivot between said seat portion and said back portion when said back portion is moved away from said exercise member keeps said back portion substantially stationary while said user is exercising without said exercise support member.

* * * * *